US006866477B2

(12) United States Patent
Arness et al.

(10) Patent No.: US 6,866,477 B2
(45) Date of Patent: Mar. 15, 2005

(54) AIRFOIL SHAPE FOR A TURBINE NOZZLE

(75) Inventors: Brian Peter Arness, Simpsonville, SC (US); Robert Romany By, Simpsonville, SC (US); Gunnar Leif Siden, Greenville, SC (US); Poornathresan Krishnakumar, Greenville, SC (US); Bruce Loren Smith, Greer, SC (US); Peter Christopher Selent, Taylors, SC (US)

(73) Assignee: General Electric Company, Schenectady, NY (US)

( * ) Notice: Subject to any disclaimer, the term of this patent is extended or adjusted under 35 U.S.C. 154(b) by 80 days.

(21) Appl. No.: 10/630,750

(22) Filed: Jul. 31, 2003

(65) Prior Publication Data

US 2005/0025618 A1 Feb. 3, 2005

(51) Int. Cl.[7] ..... F01D 9/04

(52) U.S. Cl. ..... 415/191; 415/193; 415/208.2; 415/209.1; 415/210.1; 415/211.2

(58) Field of Search ..... 415/191, 192, 415/193, 208.1, 208.2, 209.1, 209.4, 210.1, 211.2; 416/223 R, 223 A, 243, DIG. 2, DIG. 5

(56) References Cited

U.S. PATENT DOCUMENTS

| | | | | |
|---|---|---|---|---|
| 6,450,770 | B1 * | 9/2002 | Wang et al. | 416/223 A |
| 6,461,110 | B1 * | 10/2002 | By et al. | 416/223 A |
| 6,685,434 | B1 * | 2/2004 | Humanchuk et al. | 416/223 A |
| 6,715,990 | B1 * | 4/2004 | Arness et al. | 416/223 A |
| 6,722,853 | B1 * | 4/2004 | Humanchuk et al. | 416/223 A |
| 6,736,599 | B1 * | 5/2004 | Jacks et al. | 415/191 |

* cited by examiner

*Primary Examiner*—Christopher Verdier
(74) *Attorney, Agent, or Firm*—Nixon & Vanderhye P.C.

(57) ABSTRACT

The third stage nozzle has an airfoil profile substantially in accordance with Cartesian coordinate values of X, Y and Z set forth in Table I wherein X and Y values are in inches and define airfoil profile sections at each distance Z and Z are non-dimensional values within a range from 0.1 to 0.9 convertible to Z distances in inches by multiplying the Z values of Table I within the range by a height of the airfoil in inches. The profile sections at the Z distances are joined smoothly with one another to form the nozzle airfoil shape. The X and Y distances may be scalable to provide a scaled-up or scaled-down airfoil for the nozzle. The nominal airfoil given by the X, Y and Z distances lies within an envelope of ±0.160 inches.

12 Claims, 5 Drawing Sheets

AIRFOIL SHAPE FOR A TURBINE NOZZLE

BACKGROUND OF THE INVENTION

The present invention relates to an airfoil for a nozzle stage of a gas turbine and particularly relates to an airfoil for the third stage nozzle of a gas turbine.

Many specific requirements must be met for each stage of the hot gas path section of a gas turbine in order to meet design goals, including overall improved aerodynamic efficiency and aerodynamic and mechanical nozzle loading. Particularly, the third stage of the turbine section must meet efficiency, heat load, life, throat area and vectoring requirements to meet those goals.

BRIEF DESCRIPTION OF THE INVENTION

In accordance with a preferred embodiment of the present invention, there is provided an airfoil shape for a nozzle stage of a gas turbine, preferably the third stage nozzle, that enhances the performance of the gas turbine. The airfoil shape hereof improves the interaction between various blade rows in the turbine, affords improved aerodynamic efficiency through the third stage and improves the third stage blade loading. Thus, the profile of each third stage nozzle airfoil which in part defines the hot gas path annulus about the nozzle stage meets the requirements for improved stage efficiency, as well as parts life and manufacturability.

The preferred third stage nozzle is provided in nozzle segments each having an inner and outer band with the airfoils extending therebetween and spaced circumferentially from one another. In this preferred embodiment, there are sixteen (16) segments and a total of sixty-four (64) airfoils, i.e., four airfoils per segment.

The airfoil shape hereof improves aerodynamic efficiency and third stage nozzle airfoil aerodynamic and mechanical loading. The nozzle airfoil profile is defined by a unique loci of points to achieve the necessary efficiency and loading requirements whereby improved turbine performance is obtained. These unique loci of points define the nominal nozzle airfoil profile and are identified by the X, Y and Z Cartesian coordinates of Table I which follows. The points for the coordinate values shown in Table I are relative to the turbine centerline and for a cold, i.e., room temperature nozzle airfoil at various cross-sections along its length. The positive X, Y and Z directions are axially parallel to the turbine rotor centerline looking aft toward the turbine exhaust, tangentially in the direction of engine rotation looking aft and outwardly toward the outer band of the nozzle, respectively. The X and Y coordinates are given in distance dimensions, e.g., units of inches, and are joined smoothly at each Z location to form a smooth continuous airfoil cross-section. The Z coordinates are given in non-dimensionalized form from 0 to 1. By multiplying the nozzle airfoil height dimension, e.g., in inches, by the non-dimensional Z value of Table I, the airfoil shape, i.e., the profile, of the nozzle airfoil is obtained. Each defined airfoil section in the X and Y plane is joined smoothly with adjacent airfoil sections in the Z direction to form the complete nozzle airfoil shape.

It will be appreciated that as each nozzle airfoil heats up in use, the profile will change as a result of stress and temperature. Thus, the cold or room temperature profile is given by the X, Y and Z coordinates for manufacturing purposes. Because a manufactured nozzle airfoil may be different from the nominal nozzle airfoil profile given by the following table, a distance of plus or minus 0.160 inches from the nominal profile in a direction normal to any surface location along the nominal profile and which includes any coating process, defines a profile envelope for this nozzle airfoil. The airfoil shape is robust to this variation without impairment of the mechanical and aerodynamic functions of the nozzle airfoil.

It will also be appreciated that the nozzle airfoil can be scaled up or scaled down geometrically for introduction into similar turbine designs. Consequently, the X and Y coordinates in inches of the nominal airfoil profile given below in Table I may be a function of the same constant or number. That is, the X, Y coordinate values in inches may be multiplied or divided by the same constant or number to provide a scaled up or scaled down version of the nozzle airfoil profile while retaining the airfoil section shape.

In a preferred embodiment according to the present invention, there is provided a turbine nozzle including an airfoil having an airfoil shape, the airfoil having a nominal profile substantially in accordance with Cartesian coordinate values of X, Y and Z set forth in Table I wherein the Z values are non-dimensional values within a range from 0.1 to 0.90 convertible to Z distances in inches by multiplying the Z values of Table I within the range by a height of the airfoil in inches, and wherein the X and Y values are distances in inches which, when connected by smooth continuing arcs, define airfoil profile sections at each distance Z within the range thereof, the profile sections at the Z distances within the range being joined smoothly with one another to form the nozzle airfoil shape.

In a further preferred embodiment according to the present invention, there is provided a turbine nozzle including an airfoil having an uncoated nominal airfoil profile substantially in accordance with Cartesian coordinate values of X, Y and Z set forth in Table I wherein the Z values are non-dimensional values within a range from 0.1 to 0.9 convertible to Z distances in inches by multiplying the Z values of Table I within the range by a height of the airfoil in inches, and wherein the X and Y values are distances in inches which, when connected by smooth continuing arcs, define airfoil profile sections at each distance Z within the range thereof, the profile sections at the Z distances within the range thereof being joined smoothly with one another to form the nozzle airfoil shape, the X, Y and Z distances being scalable as a function of the same constant or number to provide a scaled-up or scaled-down airfoil.

In a further preferred embodiment according to the present invention, there is provided a turbine comprising a turbine stage having a plurality of nozzles, each of the nozzles including an airfoil having an airfoil shape, the airfoil having a nominal profile substantially in accordance with Cartesian coordinate values of X, Y and Z set forth in Table I wherein the Z values are non-dimensional values within a range from 0.1 to 0.9 convertible to Z distances in inches by multiplying the Z values of Table I within the range by a height of the airfoil in inches, and wherein X and Y values are distances in inches which, when connected by smooth continuing arcs, define airfoil profile sections at each distance Z within the range, the profile sections at the Z distances within the range being joined smoothly with one another to form the nozzle airfoil shape.

DETAILED DESCRIPTION OF THE INVENTION

Figure 1:
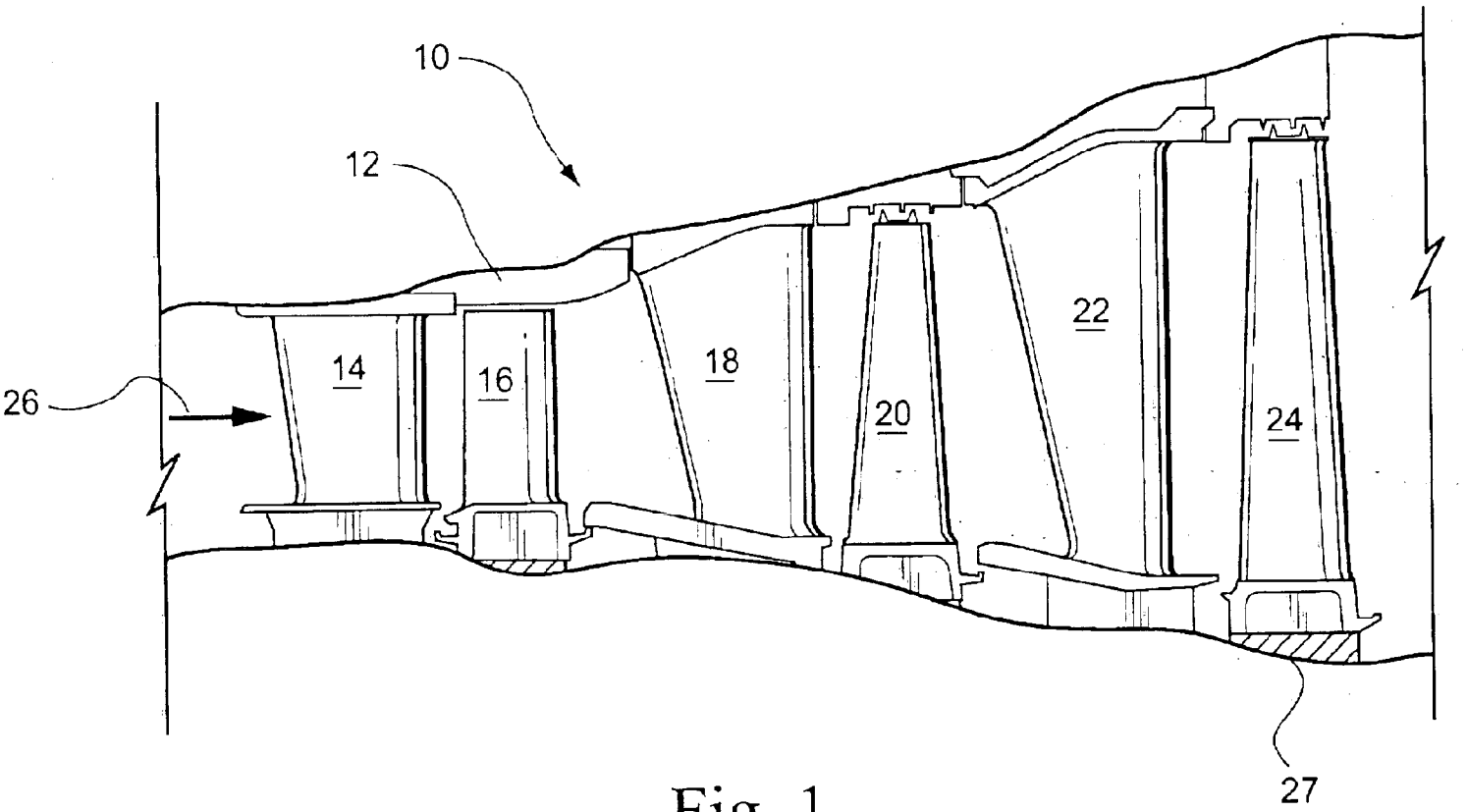
FIG. 1 is a schematic representation of a hot gas path through a gas turbine and which illustrates a third stage nozzle airfoil according to a preferred embodiment of the present invention.

Referring now to the drawings, particularly to FIG. 1, there is illustrated a portion of a multi-stage turbine section, generally designated 10, for a turbine 12 including a plurality of turbine stages. Three stages are illustrated. For example, the first stage comprises a plurality of circumferentially spaced nozzles 14 and buckets 16, the nozzles being circumferentially spaced one from the other and fixed about the axis of the turbine. The buckets 16, of course, are mounted on and circumferentially spaced from one another about the turbine rotor 27. A second stage of the turbine 12 is also illustrated, including a plurality of circumferentially spaced nozzles 18 and a plurality of buckets 20 mounted on the rotor. A third stage is also illustrated, including a plurality of circumferentially spaced nozzles 22 and buckets 24. It will be appreciated that the nozzles and buckets lie in a hot gas path of the turbine indicated by the arrow 26.

Figure 2:
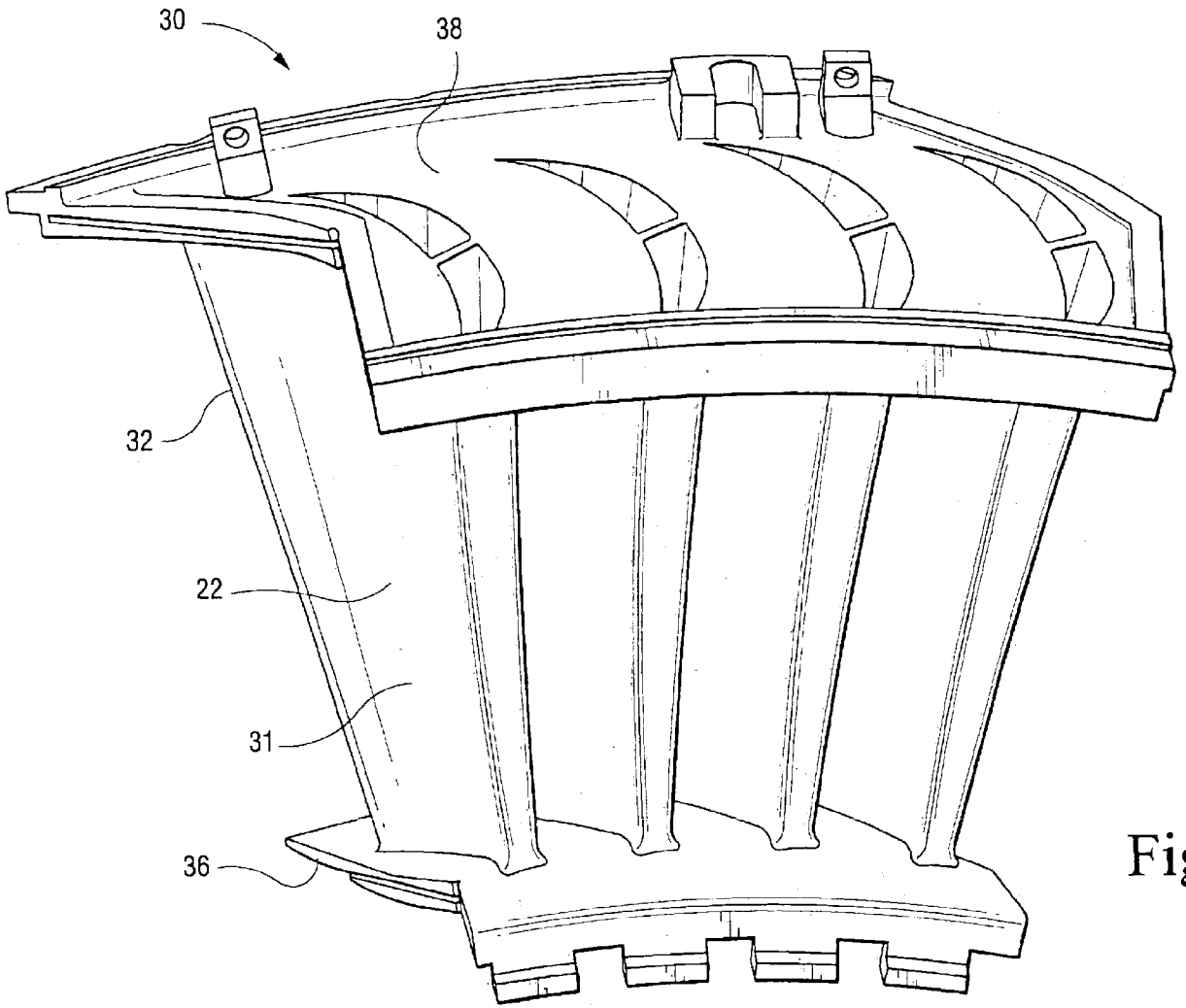
FIG. 2 is a perspective view of a third stage nozzle segment illustrating four airfoils according to the present invention disposed between inner and outer bands.
Figure 3:
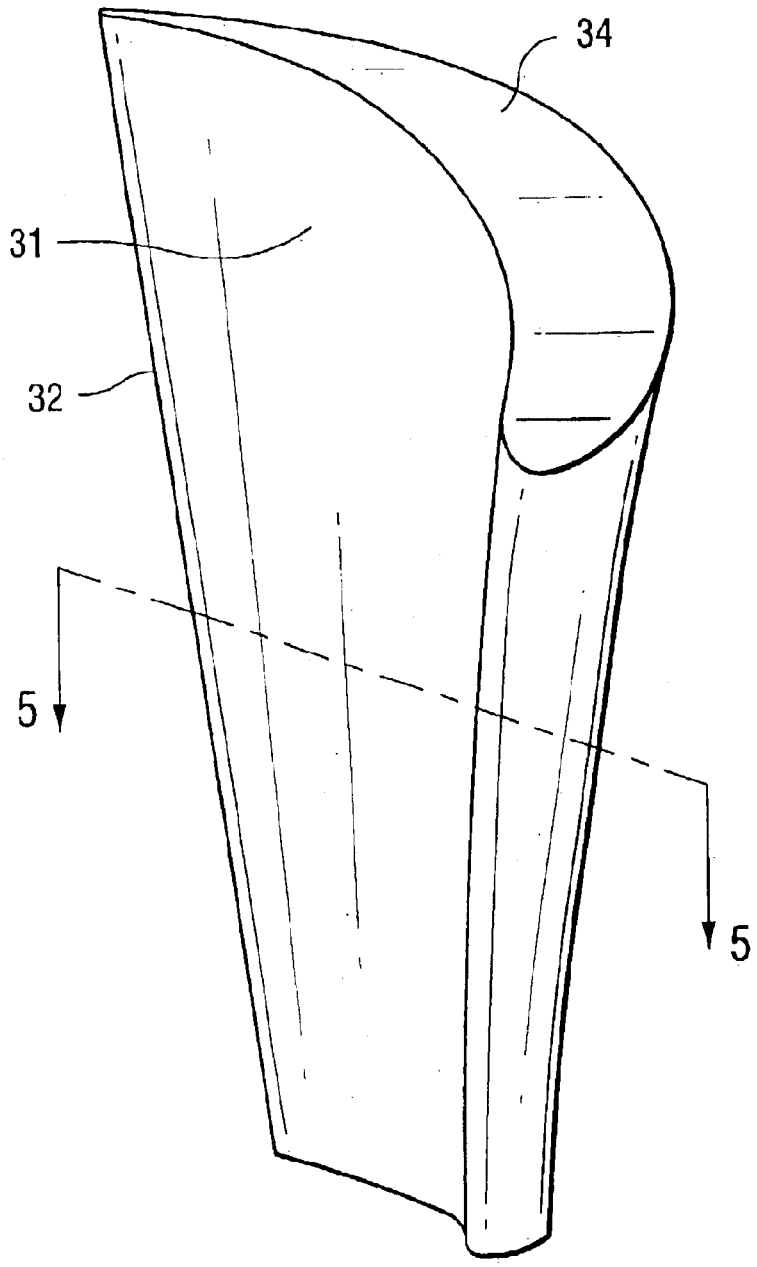
FIG. 3 is a perspective view of an airfoil of the nozzle segment illustrated in FIGS. 1 and 2.
Figure 4:
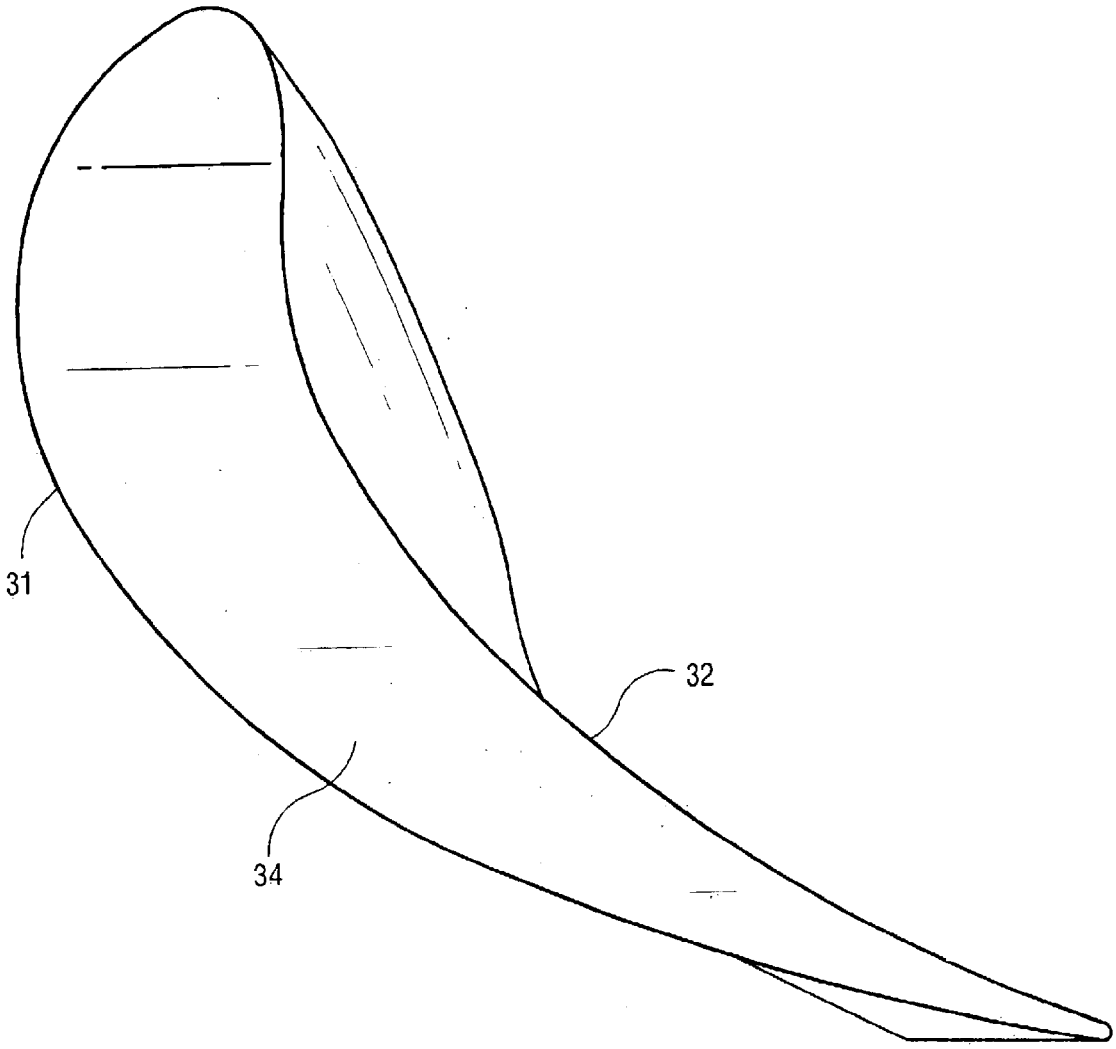
FIG. 4 is a top view of the third stage nozzle airfoil as viewed from its outer end radially inwardly toward the turbine centerline.
Figure 5:
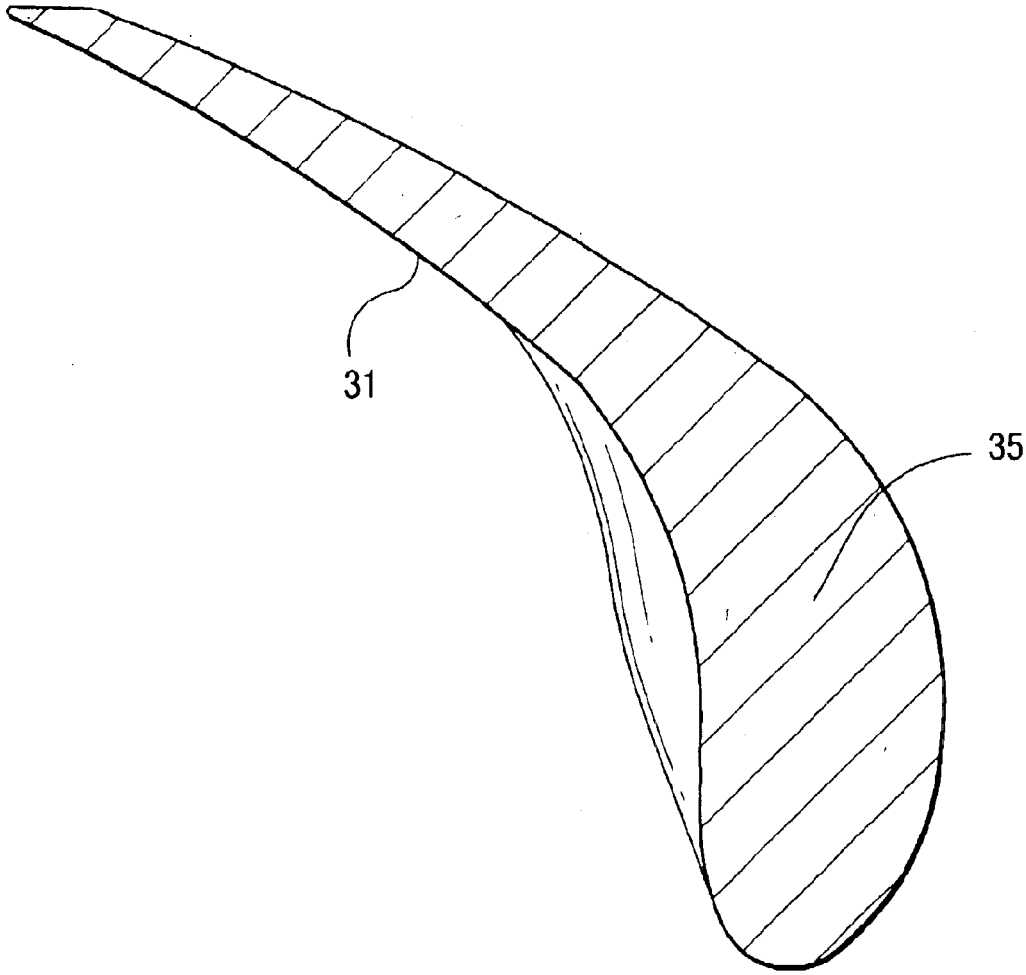
FIG. 5 is a representative airfoil profile section intermediate inner and outer ends of the airfoil and taken generally about on line 5—5 in FIG. 3.

Referring to FIG. 2, it will be appreciated that the nozzles, for example, the third stage nozzles 22, define airfoils or vanes which extend generally radially between annular inner and outer rings, respectively, which also in part define the hot gas path 26 through turbine 12. As in FIG. 2, the third nozzle stage is comprised of a plurality of nozzle segments, generally indicated 30, which are secured together to form a circumferential array of nozzle segments about the axis of rotation of the rotor. It will be appreciated that each nozzle segment 30 including one or more airfoils 31 and in this preferred embodiment, four airfoils 31, are provided for each nozzle segment 30. Airfoil 31 is defined by a vane 32 having an airfoil shape 34 in cross-section as illustrated in FIGS. 3 and 4. That is, the nozzle vane 32 has a profile at a radial cross-section in any airfoil shape 34 defining airfoil profile sections 35 (FIG. 5). The vanes 32 also extend between inner and outer bands 36 and 38, respectively, which form the inner and outer rings. In this preferred embodiment, there are four airfoils 31 for each segment 30, sixteen segments 30 and a total of sixty-four airfoils 31 for the third stage of the turbine.

To define the airfoil shape 34 of the third stage nozzle airfoil 31 which optimizes the guided hot gas turning, interactions among other stages in the turbine and overall efficiency of the turbine, there are a unique set or loci of points in space that meet the stage requirements and can be manufactured. This unique loci of points meets the requirements for nozzle loading and stage efficiency and are arrived at by iteration between aerodynamics and nozzle mechanical loading, enabling the turbine to run in an efficient, safe and smooth manner. The loci which defines the nozzle airfoil profile comprises a set of 1300 points in a Cartesian coordinate system of X, Y and Z values given in Table I below. The values for the X and Y coordinates are set forth in inches in Table I, although other units of dimensions may be used when the values are appropriately converted. The Z values set forth in Table I are non-dimensional values from 0 to 1. To convert the Z value to a Z distance in inches, the non-dimensional Z values given in Table I are multiplied by a constant in inches, e.g., the height of the nozzle airfoil. The airfoil height is measured from the root of the nozzle airfoil at the trailing edge outwardly to the airfoil tip. The height of each nozzle from Z=0 to Z=1 is 15.420 inches, and the airfoil has a root radius of 29.255 inches at the trailing edge. The coordinate system has orthogonally related X, Y and Z axes with the Z axis extending perpendicular to a plane normal to a plane containing the X and Y values. The Y axis lies parallel to the turbine rotor centerline.

By defining X and Y coordinate values at selective locations in a Z direction normal to the X, Y plane, the profile of the airfoil 31 at each Z distance can be ascertained. By connecting the X and Y values with smooth continuing arcs, each profile section at each distance Z is fixed. The surface profiles of the various surface locations between the distances Z are determined by smoothly connecting the adjacent cross-sections to one another to form the airfoil. The values set forth in Table I represent the airfoil profiles at ambient, non-operating or non-hot conditions and are for an uncoated airfoil. The sign convention assigns a positive value to Z values and positive and negative values for X and Y coordinates as typically used in the Cartesian coordinate system.

From a review of the drawing figures and Table I, it will be appreciated that the Z distances within a range of 0.0 to 1 and the corresponding X, Y coordinates embrace airfoil profiles which, respectively and in part, lie radially inwardly and outwardly of the surfaces of the inner and outer bands defining the hot gas path. Such profiles as defined by the coordinates of Table I in part are imaginary and do not exist physically as part of the airfoil between the inner and outer bands. By limiting the non-dimensional Z values within a range of Z=0.1 to Z=0.9, the airfoil profiles defined by the corresponding X, Y coordinates form and define a major portion of the airfoil between the inner and outer bands without such airfoil profiles intersecting the inner and outer bands.

The Table I values are generated and shown to four decimal places for determining the profile of the nozzle airfoil. However, the fourth decimal place is not significant and can be rounded up or down. There are typical manufacturing tolerances, as well as coatings, which must be accounted for in the actual profile of the airfoil 31. Accordingly, the values for the profile given in Table I are for a nominal airfoil. Thus, the actual profile of a manufactured nozzle airfoil 31 may lie in a range of variations between measured points on the surface of the airfoil and the ideal position of the surface as listed in Table I. The design is robust to this variation to the extent that mechanical and aerodynamic functions are not impaired. It will be therefore be appreciated that ±typical manufacturing tolerances, i.e., ±values, including any coating thicknesses, are additive to the X and Y values given in Table I below. Accordingly, a distance of ±160 inches in a direction normal to any surface location along the airfoil profile defines an airfoil profile envelope for this particular third stage nozzle airfoil.

The coordinate values are given below in Table I for the preferred nominal profile envelope.

TABLE I

| X | Y | Z |
|---|---|---|
| −0.0077 | 0.1373 | 0 |
| 0.0373 | 0.0994 | 0 |
| 0.0307 | 0.2093 | 0 |
| 0.0690 | 0.2814 | 0 |
| 0.1322 | 0.2322 | 0 |
| 0.1793 | 0.2989 | 0 |
| 0.1458 | 0.4255 | 0 |
| 0.1074 | 0.3535 | 0 |
| 0.0851 | 0.1655 | 0 |
| 0.3001 | 0.7134 | 0 |
| 0.3223 | 0.4977 | 0 |
| 0.1842 | 0.4976 | 0 |
| 0.2228 | 0.5696 | 0 |
| 0.2267 | 0.3653 | 0 |
| 0.2614 | 0.6415 | 0 |
| 0.2744 | 0.4316 | 0 |
| 0.4678 | 0.6948 | 0 |
| 0.3388 | 0.7853 | 0 |
| 0.3705 | 0.5637 | 0 |
| 0.3776 | 0.8571 | 0 |
| 0.4190 | 0.6294 | 0 |
| 0.4164 | 0.9290 | 0 |
| 0.4553 | 1.0007 | 0 |
| 0.5169 | 0.7600 | 0 |
| 0.5334 | 1.1442 | 0 |
| 0.4943 | 1.0725 | 0 |
| 0.5664 | 0.8250 | 0 |
| 0.5726 | 1.2158 | 0 |
| 0.6163 | 0.8896 | 0 |
| 0.6666 | 0.9539 | 0 |
| 0.6907 | 1.4304 | 0 |
| 0.7174 | 1.0179 | 0 |
| 0.6512 | 1.3590 | 0 |
| 0.7686 | 1.0814 | 0 |
| 0.6118 | 1.2874 | 0 |
| 0.7303 | 1.5018 | 0 |
| 0.8506 | 1.7152 | 0 |
| 0.8728 | 1.2072 | 0 |
| 0.8103 | 1.6442 | 0 |
| 0.9257 | 1.2694 | 0 |
| 0.7702 | 1.5731 | 0 |
| 0.8204 | 1.1446 | 0 |
| 1.0150 | 1.9974 | 0 |
| 1.0889 | 1.4521 | 0 |
| 0.9733 | 1.9272 | 0 |
| 0.9321 | 1.8567 | 0 |
| 0.9794 | 1.3309 | 0 |
| 0.8912 | 1.7860 | 0 |
| 1.0338 | 1.3918 | 0 |
| 1.1870 | 2.2750 | 0 |
| 1.3231 | 2.4787 | 0 |
| 1.2769 | 2.4114 | 0 |
| 1.2315 | 2.3435 | 0 |
| 1.3181 | 1.6847 | 0 |
| 1.1431 | 2.2062 | 0 |
| 1.1449 | 1.5115 | 0 |
| 1.0999 | 2.1369 | 0 |
| 1.2017 | 1.5702 | 0 |
| 1.0572 | 2.0673 | 0 |
| 1.2594 | 1.6279 | 0 |
| 1.3778 | 1.7404 | 0 |
| 1.4386 | 1.7949 | 0 |
| 1.5004 | 1.8482 | 0 |
| 1.7597 | 2.0467 | 0 |
| 1.5197 | 2.7394 | 0 |
| 1.5634 | 1.9001 | 0 |
| 1.8276 | 2.0919 | 0 |
| 1.6857 | 2.9193 | 0 |
| 1.4684 | 2.6759 | 0 |
| 1.6276 | 1.9506 | 0 |
| 1.6282 | 2.8614 | 0 |
| 1.4186 | 2.6111 | 0 |
| 1.6930 | 1.9995 | 0 |
| 1.5729 | 2.8013 | 0 |
| 1.3703 | 2.5453 | 0 |
| 2.0133 | 3.1606 | 0 |
| 2.0396 | 2.2144 | 0 |

TABLE I-continued

| X | Y | Z |
|---|---|---|
| 1.7458 | 2.9746 | 0 |
| 1.9421 | 3.1205 | 0 |
| 2.1130 | 2.2502 | 0 |
| 1.8969 | 2.1351 | 0 |
| 1.8739 | 3.0757 | 0 |
| 2.1877 | 2.2833 | 0 |
| 2.0873 | 3.1951 | 0 |
| 1.9676 | 2.1760 | 0 |
| 1.8085 | 3.0269 | 0 |
| 2.2635 | 2.3136 | 0 |
| 2.3224 | 3.2617 | 0 |
| 2.3403 | 2.3413 | 0 |
| 2.6555 | 2.4260 | 0 |
| 2.2423 | 3.2459 | 0 |
| 2.4180 | 2.3663 | 0 |
| 2.4851 | 3.2733 | 0 |
| 2.1637 | 3.2236 | 0 |
| 2.4965 | 2.3887 | 0 |
| 2.4035 | 3.2708 | 0 |
| 2.5757 | 2.4086 | 0 |
| 2.5666 | 3.2689 | 0 |
| 2.9781 | 2.4760 | 0 |
| 2.8052 | 3.2161 | 0 |
| 2.7357 | 2.4409 | 0 |
| 2.7271 | 3.2399 | 0 |
| 2.8164 | 2.4536 | 0 |
| 2.6474 | 3.2577 | 0 |
| 2.8973 | 2.4649 | 0 |
| 3.2159 | 2.5323 | 0 |
| 3.1647 | 3.0256 | 0 |
| 2.8813 | 3.1867 | 0 |
| 3.0973 | 3.0716 | 0 |
| 3.0587 | 2.4891 | 0 |
| 3.0274 | 3.1138 | 0 |
| 3.1385 | 2.5066 | 0 |
| 2.9554 | 3.1524 | 0 |
| 3.3733 | 2.7805 | 0 |
| 3.2876 | 2.5711 | 0 |
| 3.3370 | 2.8533 | 0 |
| 3.3476 | 2.6260 | 0 |
| 3.2868 | 2.9177 | 0 |
| 3.3803 | 2.6999 | 0 |
| 3.2286 | 2.9748 | 0 |
| 0.7393 | 1.4543 | 0.1 |
| 0.7822 | 1.5334 | 0.1 |
| 0.9126 | 1.7694 | 0.1 |
| 0.8253 | 1.6122 | 0.1 |
| 0.8688 | 1.6909 | 0.1 |
| 0.9568 | 1.8477 | 0.1 |
| 1.0015 | 1.9258 | 0.1 |
| 1.0466 | 2.0035 | 0.1 |
| 0.0905 | 0.0535 | 0.1 |
| −0.0112 | 0.0206 | 0.1 |
| 0.0390 | −0.0200 | 0.1 |
| 0.0300 | 0.1005 | 0.1 |
| 0.0711 | 0.1805 | 0.1 |
| 0.1123 | 0.2604 | 0.1 |
| 0.1536 | 0.3403 | 0.1 |
| 0.2445 | 0.2750 | 0.1 |
| 0.1949 | 0.4201 | 0.1 |
| 0.1930 | 0.2013 | 0.1 |
| 0.1416 | 0.1275 | 0.1 |
| 0.2776 | 0.5798 | 0.1 |
| 0.3191 | 0.6595 | 0.1 |
| 0.3607 | 0.7393 | 0.1 |
| 0.2362 | 0.5000 | 0.1 |
| 0.5060 | 0.6406 | 0.1 |
| 0.4440 | 0.8986 | 0.1 |
| 0.4529 | 0.5680 | 0.1 |
| 0.4858 | 0.9782 | 0.1 |
| 0.4023 | 0.8189 | 0.1 |
| 0.2961 | 0.3486 | 0.1 |
| 0.4003 | 0.4951 | 0.1 |
| 0.3481 | 0.4220 | 0.1 |
| 0.6119 | 1.2166 | 0.1 |
| 0.6676 | 0.8565 | 0.1 |
| 0.6133 | 0.7849 | 0.1 |

TABLE I-continued

| X | Y | Z |
|---|---|---|
| 0.5277 | 1.0577 | 0.1 |
| 0.5594 | 0.7129 | 0.1 |
| 0.5698 | 1.1372 | 0.1 |
| 0.7225 | 0.9278 | 0.1 |
| 0.6542 | 1.2959 | 0.1 |
| 0.8337 | 1.0691 | 0.1 |
| 0.6966 | 1.3752 | 0.1 |
| 0.7778 | 0.9986 | 0.1 |
| 0.9474 | 1.2084 | 0.1 |
| 0.8902 | 1.1390 | 0.1 |
| 1.0052 | 1.2772 | 0.1 |
| 1.1234 | 1.4127 | 0.1 |
| 1.0639 | 1.3453 | 0.1 |
| 1.1839 | 1.4793 | 0.1 |
| 1.1388 | 2.1579 | 0.1 |
| 1.1860 | 2.2344 | 0.1 |
| 1.2340 | 2.3104 | 0.1 |
| 1.2829 | 2.3859 | 0.1 |
| 1.3327 | 2.4607 | 0.1 |
| 1.3837 | 2.5348 | 0.1 |
| 1.7234 | 2.9530 | 0.1 |
| 1.6617 | 2.8877 | 0.1 |
| 1.4897 | 2.6800 | 0.1 |
| 1.5450 | 2.7509 | 0.1 |
| 1.4359 | 2.6079 | 0.1 |
| 1.6023 | 2.8202 | 0.1 |
| 1.9248 | 3.1321 | 0.1 |
| 1.7878 | 3.0158 | 0.1 |
| 1.8548 | 3.0757 | 0.1 |
| 1.9977 | 3.1848 | 0.1 |
| 2.0735 | 3.2330 | 0.1 |
| 2.1523 | 3.2764 | 0.1 |
| 2.2369 | 2.3087 | 0.1 |
| 2.3188 | 2.3458 | 0.1 |
| 2.2337 | 3.3143 | 0.1 |
| 2.3177 | 3.3463 | 0.1 |
| 2.4038 | 3.3722 | 0.1 |
| 2.4915 | 3.3919 | 0.1 |
| 2.4866 | 2.4103 | 0.1 |
| 2.4020 | 2.3797 | 0.1 |
| 2.5722 | 2.4376 | 0.1 |
| 2.7463 | 2.4823 | 0.1 |
| 2.6589 | 2.4616 | 0.1 |
| 1.0924 | 2.0809 | 0.1 |
| 1.3076 | 1.6097 | 0.1 |
| 1.2452 | 1.5450 | 0.1 |
| 1.3711 | 1.6734 | 0.1 |
| 1.5015 | 1.7971 | 0.1 |
| 1.4357 | 1.7359 | 0.1 |
| 1.6370 | 1.9153 | 0.1 |
| 1.5686 | 1.8570 | 0.1 |
| 1.7067 | 1.9721 | 0.1 |
| 1.9246 | 2.1309 | 0.1 |
| 1.8505 | 2.0800 | 0.1 |
| 1.7779 | 2.0270 | 0.1 |
| 2.0776 | 2.2253 | 0.1 |
| 2.0004 | 2.1794 | 0.1 |
| 2.1565 | 2.2684 | 0.1 |
| 2.5804 | 3.4053 | 0.1 |
| 2.6700 | 3.4123 | 0.1 |
| 2.7599 | 3.4130 | 0.1 |
| 2.8496 | 3.4073 | 0.1 |
| 2.9387 | 3.3953 | 0.1 |
| 3.0267 | 3.3772 | 0.1 |
| 3.1133 | 3.3530 | 0.1 |
| 3.2807 | 3.2877 | 0.1 |
| 3.3609 | 3.2472 | 0.1 |
| 3.4387 | 3.2021 | 0.1 |
| 3.1981 | 3.3231 | 0.1 |
| 3.5133 | 3.1519 | 0.1 |
| 2.8345 | 2.5001 | 0.1 |
| 3.0121 | 2.5277 | 0.1 |
| 2.9231 | 2.5151 | 0.1 |
| 3.1906 | 2.5494 | 0.1 |
| 3.1014 | 2.5388 | 0.1 |
| 3.2798 | 2.5606 | 0.1 |
| 3.5428 | 2.6179 | 0.1 |

TABLE I-continued

| X | Y | Z |
|---|---|---|
| 3.4569 | 2.5917 | 0.1 |
| 3.3688 | 2.5739 | 0.1 |
| 3.7383 | 2.8795 | 0.1 |
| 3.5835 | 3.0958 | 0.1 |
| 3.7373 | 2.7905 | 0.1 |
| 3.6473 | 3.0326 | 0.1 |
| 3.6937 | 2.7130 | 0.1 |
| 3.7019 | 2.9612 | 0.1 |
| 3.6235 | 2.6572 | 0.1 |
| 1.4279 | 2.6010 | 0.2 |
| 1.4850 | 2.6815 | 0.2 |
| 1.5438 | 2.7608 | 0.2 |
| 1.6045 | 2.8387 | 0.2 |
| 1.6674 | 2.9149 | 0.2 |
| 1.7326 | 2.9890 | 0.2 |
| 1.8004 | 3.0608 | 0.2 |
| 1.9446 | 3.1956 | 0.2 |
| 1.8710 | 3.1298 | 0.2 |
| 2.0212 | 3.2578 | 0.2 |
| 2.1011 | 3.3158 | 0.2 |
| 2.2704 | 3.4173 | 0.2 |
| 2.3595 | 3.4599 | 0.2 |
| 2.1842 | 3.3691 | 0.2 |
| 2.4511 | 3.4965 | 0.2 |
| 2.5451 | 3.5268 | 0.2 |
| 0.5108 | 0.9659 | 0.2 |
| 0.4223 | 0.7894 | 0.2 |
| 0.4665 | 0.8777 | 0.2 |
| 0.0288 | −0.0075 | 0.2 |
| 0.0724 | 0.0812 | 0.2 |
| 0.0962 | −0.0562 | 0.2 |
| −0.0147 | −0.0961 | 0.2 |
| 0.2610 | 0.1900 | 0.2 |
| 0.2031 | 0.3470 | 0.2 |
| 0.2059 | 0.1080 | 0.2 |
| 0.1509 | 0.0261 | 0.2 |
| 0.1159 | 0.1698 | 0.2 |
| 0.1595 | 0.2584 | 0.2 |
| 0.0414 | −0.1382 | 0.2 |
| 0.3343 | 0.6126 | 0.2 |
| 0.3782 | 0.7010 | 0.2 |
| 0.4279 | 0.4347 | 0.2 |
| 0.2468 | 0.4355 | 0.2 |
| 0.3719 | 0.3534 | 0.2 |
| 0.2905 | 0.5241 | 0.2 |
| 0.3164 | 0.2717 | 0.2 |
| 0.4842 | 0.5158 | 0.2 |
| 0.5983 | 0.6770 | 0.2 |
| 0.5410 | 0.5966 | 0.2 |
| 0.5553 | 1.0540 | 0.2 |
| 0.6000 | 1.1421 | 0.2 |
| 0.6449 | 1.2300 | 0.2 |
| 0.7144 | 0.8368 | 0.2 |
| 0.6900 | 1.3179 | 0.2 |
| 0.8930 | 1.0731 | 0.2 |
| 0.7354 | 1.4056 | 0.2 |
| 0.8328 | 0.9948 | 0.2 |
| 0.7811 | 1.4931 | 0.2 |
| 0.7733 | 0.9160 | 0.2 |
| 0.8735 | 1.6676 | 0.2 |
| 0.9203 | 1.7546 | 0.2 |
| 1.0638 | 2.0137 | 0.2 |
| 0.9676 | 1.8412 | 0.2 |
| 1.0154 | 1.9277 | 0.2 |
| 1.0155 | 1.2280 | 0.2 |
| 0.8271 | 1.5805 | 0.2 |
| 0.9539 | 1.1508 | 0.2 |
| 1.1415 | 1.3800 | 0.2 |
| 1.0781 | 1.3044 | 0.2 |
| 1.2060 | 1.4548 | 0.2 |
| 0.6561 | 0.7571 | 0.2 |
| 1.2135 | 2.2693 | 0.2 |
| 1.2653 | 2.3534 | 0.2 |
| 1.1128 | 2.0994 | 0.2 |
| 1.1627 | 2.1846 | 0.2 |
| 1.3182 | 2.4368 | 0.2 |
| 1.3724 | 2.5193 | 0.2 |

TABLE I-continued

| X | Y | Z |
|---|---|---|
| 1.4059 | 1.6734 | 0.2 |
| 1.3381 | 1.6016 | 0.2 |
| 1.2715 | 1.5287 | 0.2 |
| 1.5454 | 1.8132 | 0.2 |
| 1.4749 | 1.7440 | 0.2 |
| 1.7658 | 2.0110 | 0.2 |
| 1.9210 | 2.1331 | 0.2 |
| 1.8425 | 2.0732 | 0.2 |
| 1.6907 | 1.9468 | 0.2 |
| 1.6173 | 1.8808 | 0.2 |
| 2.0013 | 2.1905 | 0.2 |
| 2.1677 | 2.2967 | 0.2 |
| 2.0835 | 2.2452 | 0.2 |
| 2.2539 | 2.3448 | 0.2 |
| 2.3420 | 2.3894 | 0.2 |
| 2.6162 | 2.5011 | 0.2 |
| 2.5233 | 2.4676 | 0.2 |
| 2.4319 | 2.4304 | 0.2 |
| 2.7105 | 2.5305 | 0.2 |
| 2.6409 | 3.5507 | 0.2 |
| 2.7381 | 3.5681 | 0.2 |
| 2.8362 | 3.5792 | 0.2 |
| 2.9348 | 3.5839 | 0.2 |
| 2.9996 | 2.5941 | 0.2 |
| 2.9024 | 2.5769 | 0.2 |
| 2.8059 | 2.5558 | 0.2 |
| 3.0335 | 3.5823 | 0.2 |
| 3.2935 | 2.6304 | 0.2 |
| 3.1319 | 3.5745 | 0.2 |
| 3.1953 | 2.6202 | 0.2 |
| 3.0973 | 2.6083 | 0.2 |
| 3.3918 | 2.6397 | 0.2 |
| 3.3263 | 3.5405 | 0.2 |
| 3.4216 | 3.5145 | 0.2 |
| 3.5884 | 2.6590 | 0.2 |
| 3.4901 | 2.6490 | 0.2 |
| 3.2297 | 3.5605 | 0.2 |
| 3.7833 | 2.6900 | 0.2 |
| 3.6946 | 3.4006 | 0.2 |
| 3.6863 | 2.6715 | 0.2 |
| 3.7803 | 3.3516 | 0.2 |
| 3.5149 | 3.4824 | 0.2 |
| 3.8778 | 2.7182 | 0.2 |
| 3.6060 | 3.4443 | 0.2 |
| 4.0095 | 3.1657 | 0.2 |
| 4.0478 | 2.8165 | 0.2 |
| 3.9674 | 2.7595 | 0.2 |
| 3.8624 | 3.2968 | 0.2 |
| 3.9395 | 3.2353 | 0.2 |
| 4.0689 | 3.0870 | 0.2 |
| 4.1061 | 2.9961 | 0.2 |
| 4.1007 | 2.8985 | 0.2 |
| 0.1635 | 0.1801 | 0.3 |
| 0.3003 | 0.4748 | 0.3 |
| 0.3351 | 0.2024 | 0.3 |
| 0.2090 | 0.2784 | 0.3 |
| 0.2546 | 0.3766 | 0.3 |
| 0.3461 | 0.5729 | 0.3 |
| 0.5122 | 0.4748 | 0.3 |
| 0.3920 | 0.6710 | 0.3 |
| 0.4528 | 0.3842 | 0.3 |
| 0.4381 | 0.7690 | 0.3 |
| 0.3938 | 0.2934 | 0.3 |
| 1.0146 | 1.9336 | 0.3 |
| 1.0660 | 2.0290 | 0.3 |
| 1.1182 | 2.1239 | 0.3 |
| 0.5776 | 1.0624 | 0.3 |
| 0.6246 | 1.1600 | 0.3 |
| 0.6719 | 1.2574 | 0.3 |
| 0.7195 | 1.3547 | 0.3 |
| 0.7674 | 1.4519 | 0.3 |
| 0.5721 | 0.5650 | 0.3 |
| 0.4844 | 0.8669 | 0.3 |
| 0.5309 | 0.9647 | 0.3 |
| 0.6934 | 0.7445 | 0.3 |
| 0.6324 | 0.6549 | 0.3 |
| 0.8171 | 0.9223 | 0.3 |

TABLE I-continued

| X | Y | Z |
|---|---|---|
| 0.7549 | 0.8336 | 0.3 |
| 0.8799 | 1.0105 | 0.3 |
| 0.8158 | 1.5488 | 0.3 |
| 1.0734 | 1.2715 | 0.3 |
| 0.8646 | 1.6454 | 0.3 |
| 1.0080 | 1.1852 | 0.3 |
| 0.9140 | 1.7418 | 0.3 |
| 0.9436 | 1.0981 | 0.3 |
| 0.9640 | 1.8379 | 0.3 |
| 1.2073 | 1.4418 | 0.3 |
| 1.1398 | 1.3571 | 0.3 |
| 1.2255 | 2.3120 | 0.3 |
| 1.2809 | 2.4051 | 0.3 |
| 1.1713 | 2.2183 | 0.3 |
| 1.4555 | 2.6790 | 0.3 |
| 1.3376 | 2.4974 | 0.3 |
| 1.3958 | 2.5887 | 0.3 |
| 1.5170 | 2.7682 | 0.3 |
| 1.5805 | 2.8559 | 0.3 |
| 1.6461 | 2.9421 | 0.3 |
| 1.7141 | 3.0264 | 0.3 |
| 1.7847 | 3.1085 | 0.3 |
| 1.7983 | 2.0740 | 0.3 |
| 1.7184 | 2.0009 | 0.3 |
| 1.8803 | 2.1447 | 0.3 |
| 1.9645 | 2.2129 | 0.3 |
| 1.3459 | 1.6082 | 0.3 |
| 1.2760 | 1.5255 | 0.3 |
| 1.4172 | 1.6897 | 0.3 |
| 1.5643 | 1.8487 | 0.3 |
| 1.4900 | 1.7699 | 0.3 |
| 1.6404 | 1.9257 | 0.3 |
| 1.9346 | 3.2648 | 0.3 |
| 2.0143 | 3.3381 | 0.3 |
| 1.8581 | 3.1881 | 0.3 |
| 2.0973 | 3.4076 | 0.3 |
| 2.1838 | 3.4728 | 0.3 |
| 2.1396 | 2.3402 | 0.3 |
| 2.0509 | 2.2782 | 0.3 |
| 2.2308 | 2.3986 | 0.3 |
| 2.3245 | 2.4529 | 0.3 |
| 2.2737 | 3.5331 | 0.3 |
| 2.6197 | 2.5880 | 0.3 |
| 2.3671 | 3.5880 | 0.3 |
| 2.5191 | 2.5478 | 0.3 |
| 2.4637 | 3.6369 | 0.3 |
| 2.4207 | 2.5027 | 0.3 |
| 2.7221 | 2.6233 | 0.3 |
| 2.5632 | 3.6796 | 0.3 |
| 0.1180 | 0.0818 | 0.3 |
| 0.1025 | −0.1631 | 0.3 |
| −0.0184 | −0.2131 | 0.3 |
| 0.0445 | −0.2545 | 0.3 |
| 0.0271 | −0.1148 | 0.3 |
| 0.0725 | −0.0165 | 0.3 |
| 0.1602 | −0.0715 | 0.3 |
| 0.2767 | 0.1112 | 0.3 |
| 0.2184 | 0.0199 | 0.3 |
| 2.6653 | 3.7156 | 0.3 |
| 2.7696 | 3.7446 | 0.3 |
| 2.8757 | 3.7665 | 0.3 |
| 3.0909 | 3.7896 | 0.3 |
| 2.9829 | 3.7815 | 0.3 |
| 3.0376 | 2.6996 | 0.3 |
| 2.9313 | 2.6789 | 0.3 |
| 2.8260 | 2.6535 | 0.3 |
| 3.3602 | 2.7373 | 0.3 |
| 3.2523 | 2.7280 | 0.3 |
| 3.1447 | 2.7157 | 0.3 |
| 3.1992 | 3.7910 | 0.3 |
| 3.3073 | 3.7858 | 0.3 |
| 3.4150 | 3.7742 | 0.3 |
| 3.5218 | 3.7563 | 0.3 |
| 3.6274 | 3.7324 | 0.3 |
| 3.7314 | 3.7022 | 0.3 |
| 3.6846 | 2.7557 | 0.3 |
| 3.5764 | 2.7501 | 0.3 |

TABLE I-continued

| X | Y | Z |
|---|---|---|
| 3.4683 | 2.7443 | 0.3 |
| 3.7927 | 2.7625 | 0.3 |
| 3.9006 | 2.7716 | 0.3 |
| 3.9330 | 3.6234 | 0.3 |
| 4.0299 | 3.5751 | 0.3 |
| 3.8334 | 3.6659 | 0.3 |
| 4.2139 | 3.4611 | 0.3 |
| 4.4790 | 3.1304 | 0.3 |
| 4.2986 | 3.3936 | 0.3 |
| 4.4697 | 3.0236 | 0.3 |
| 4.3754 | 3.3173 | 0.3 |
| 4.1239 | 3.5212 | 0.3 |
| 4.4402 | 3.2307 | 0.3 |
| 4.2190 | 2.8327 | 0.3 |
| 4.1147 | 2.8039 | 0.3 |
| 4.0081 | 2.7846 | 0.3 |
| 4.4079 | 2.9361 | 0.3 |
| 4.3182 | 2.8758 | 0.3 |
| 0.6427 | 1.1858 | 0.4 |
| 0.7419 | 1.4004 | 0.4 |
| 0.7921 | 1.5075 | 0.4 |
| 0.6921 | 1.2932 | 0.4 |
| 1.1651 | 2.2462 | 0.4 |
| 1.0540 | 2.0374 | 0.4 |
| 1.1090 | 2.1421 | 0.4 |
| 0.9468 | 1.8266 | 0.4 |
| 0.9999 | 1.9323 | 0.4 |
| 0.8430 | 1.6142 | 0.4 |
| 0.8945 | 1.7206 | 0.4 |
| 1.0616 | 1.2268 | 0.4 |
| 1.2734 | 1.5113 | 0.4 |
| 1.2015 | 1.4174 | 0.4 |
| 1.1310 | 1.3226 | 0.4 |
| 0.0479 | −0.3697 | 0.4 |
| 0.0249 | −0.2216 | 0.4 |
| 0.0717 | −0.1130 | 0.4 |
| 0.1085 | −0.2682 | 0.4 |
| −0.0220 | −0.3302 | 0.4 |
| 0.1653 | 0.1041 | 0.4 |
| 0.2122 | 0.2126 | 0.4 |
| 0.2300 | −0.0654 | 0.4 |
| 0.1691 | −0.1667 | 0.4 |
| 0.1185 | −0.0045 | 0.4 |
| 0.3537 | 0.5379 | 0.4 |
| 0.2592 | 0.3211 | 0.4 |
| 0.3064 | 0.4296 | 0.4 |
| 0.5386 | 0.4389 | 0.4 |
| 0.4012 | 0.6462 | 0.4 |
| 0.4761 | 0.3385 | 0.4 |
| 0.4489 | 0.7544 | 0.4 |
| 0.4969 | 0.8624 | 0.4 |
| 0.2911 | 0.0359 | 0.4 |
| 0.4141 | 0.2378 | 0.4 |
| 0.3525 | 0.1369 | 0.4 |
| 0.5451 | 0.9704 | 0.4 |
| 0.7293 | 0.7380 | 0.4 |
| 0.5938 | 1.0781 | 0.4 |
| 0.6651 | 0.6387 | 0.4 |
| 0.6016 | 0.5389 | 0.4 |
| 0.7941 | 0.8368 | 0.4 |
| 0.9261 | 1.0330 | 0.4 |
| 0.8597 | 0.9352 | 0.4 |
| 0.9934 | 1.1303 | 0.4 |
| 1.6012 | 2.9490 | 0.4 |
| 1.6715 | 3.0440 | 0.4 |
| 1.7444 | 3.1371 | 0.4 |
| 1.8202 | 3.2278 | 0.4 |
| 1.3416 | 2.5538 | 0.4 |
| 1.2225 | 2.3495 | 0.4 |
| 1.2812 | 2.4521 | 0.4 |
| 1.4036 | 2.6545 | 0.4 |
| 1.4674 | 2.7540 | 0.4 |
| 1.4980 | 1.7858 | 0.4 |
| 1.4215 | 1.6956 | 0.4 |
| 1.3467 | 1.6041 | 0.4 |
| 1.5761 | 1.8745 | 0.4 |
| 1.6562 | 1.9615 | 0.4 |

TABLE I-continued

| X | Y | Z |
|---|---|---|
| 1.5333 | 2.8522 | 0.4 |
| 1.9098 | 2.2094 | 0.4 |
| 1.9992 | 2.2867 | 0.4 |
| 1.8229 | 2.1292 | 0.4 |
| 1.7385 | 2.0465 | 0.4 |
| 1.8991 | 3.3159 | 0.4 |
| 1.9812 | 3.4010 | 0.4 |
| 2.0667 | 3.4826 | 0.4 |
| 2.1558 | 3.5603 | 0.4 |
| 2.2486 | 3.6336 | 0.4 |
| 2.3450 | 3.7020 | 0.4 |
| 2.4451 | 3.7648 | 0.4 |
| 2.5488 | 3.8216 | 0.4 |
| 2.1861 | 2.4316 | 0.4 |
| 2.0913 | 2.3609 | 0.4 |
| 2.2837 | 2.4983 | 0.4 |
| 2.3842 | 2.5605 | 0.4 |
| 2.5941 | 2.6692 | 0.4 |
| 2.4877 | 2.6176 | 0.4 |
| 2.8143 | 2.7550 | 0.4 |
| 2.7030 | 2.7151 | 0.4 |
| 2.6559 | 3.8718 | 0.4 |
| 2.7659 | 3.9151 | 0.4 |
| 2.8785 | 3.9511 | 0.4 |
| 2.9932 | 3.9794 | 0.4 |
| 3.1096 | 4.0002 | 0.4 |
| 3.0426 | 2.8161 | 0.4 |
| 2.9276 | 2.7887 | 0.4 |
| 3.3935 | 2.8661 | 0.4 |
| 3.2759 | 2.8544 | 0.4 |
| 3.1588 | 2.8379 | 0.4 |
| 3.4633 | 4.0178 | 0.4 |
| 3.2271 | 4.0134 | 0.4 |
| 3.3451 | 4.0193 | 0.4 |
| 3.5813 | 4.0093 | 0.4 |
| 3.6985 | 3.9940 | 0.4 |
| 3.5115 | 2.8738 | 0.4 |
| 3.6297 | 2.8786 | 0.4 |
| 3.9843 | 2.8853 | 0.4 |
| 3.8661 | 2.8831 | 0.4 |
| 3.7479 | 2.8813 | 0.4 |
| 3.9295 | 3.9441 | 0.4 |
| 4.0425 | 3.9095 | 0.4 |
| 3.8147 | 3.9722 | 0.4 |
| 4.3673 | 3.7679 | 0.4 |
| 4.1534 | 3.8685 | 0.4 |
| 4.2618 | 3.8212 | 0.4 |
| 4.2204 | 2.8979 | 0.4 |
| 4.1024 | 2.8898 | 0.4 |
| 4.4543 | 2.9317 | 0.4 |
| 4.3378 | 2.9113 | 0.4 |
| 4.5686 | 2.9618 | 0.4 |
| 4.4697 | 3.7089 | 0.4 |
| 4.5681 | 3.6433 | 0.4 |
| 4.7446 | 3.4867 | 0.4 |
| 4.7759 | 3.0721 | 0.4 |
| 4.6778 | 3.0067 | 0.4 |
| 4.6606 | 3.5698 | 0.4 |
| 4.8457 | 3.1662 | 0.4 |
| 4.8155 | 3.3922 | 0.4 |
| 4.8574 | 3.2826 | 0.4 |
| 1.2621 | 2.4843 | 0.5 |
| 1.1401 | 2.2589 | 0.5 |
| 1.2003 | 2.3720 | 0.5 |
| 1.3257 | 2.5956 | 0.5 |
| 1.3912 | 2.7057 | 0.5 |
| 1.4589 | 2.8145 | 0.5 |
| 1.6764 | 3.1315 | 0.5 |
| 1.7543 | 3.2333 | 0.5 |
| 1.5289 | 2.9219 | 0.5 |
| 1.6013 | 3.0276 | 0.5 |
| 2.6127 | 3.9922 | 0.5 |
| 1.8352 | 3.3326 | 0.5 |
| 1.9195 | 3.4292 | 0.5 |
| 2.0072 | 3.5226 | 0.5 |
| 2.0986 | 3.6124 | 0.5 |
| 2.1937 | 3.6983 | 0.5 |

TABLE I-continued

| X | Y | Z |
|---|---|---|
| 2.1426 | 2.4089 | 0.5 |
| 2.0450 | 2.3259 | 0.5 |
| 2.2431 | 2.4885 | 0.5 |
| 2.3467 | 2.5640 | 0.5 |
| 2.5022 | 3.9272 | 0.5 |
| 2.6761 | 2.7616 | 0.5 |
| 2.5631 | 2.7011 | 0.5 |
| 2.2927 | 3.7797 | 0.5 |
| 2.4533 | 2.6350 | 0.5 |
| 2.3956 | 3.8562 | 0.5 |
| 2.7920 | 2.8161 | 0.5 |
| 2.7267 | 4.0507 | 0.5 |
| 2.8440 | 4.1022 | 0.5 |
| 2.9642 | 4.1465 | 0.5 |
| 3.0870 | 4.1832 | 0.5 |
| 3.0319 | 2.9060 | 0.5 |
| 2.9107 | 2.8644 | 0.5 |
| 3.1553 | 2.9408 | 0.5 |
| 3.4067 | 2.9902 | 0.5 |
| 3.2804 | 2.9687 | 0.5 |
| 3.2119 | 4.2120 | 0.5 |
| 3.3383 | 4.2329 | 0.5 |
| 3.4658 | 4.2460 | 0.5 |
| 3.5938 | 4.2513 | 0.5 |
| 3.6616 | 3.0159 | 0.5 |
| 3.5339 | 3.0057 | 0.5 |
| 3.9178 | 3.0242 | 0.5 |
| 3.7897 | 3.0216 | 0.5 |
| 3.9767 | 4.2223 | 0.5 |
| 3.7219 | 4.2490 | 0.5 |
| 3.8497 | 4.2393 | 0.5 |
| 4.1026 | 4.1984 | 0.5 |
| 4.2270 | 4.1676 | 0.5 |
| 4.1741 | 3.0246 | 0.5 |
| 4.0460 | 3.0247 | 0.5 |
| 4.4304 | 3.0286 | 0.5 |
| 4.3023 | 3.0253 | 0.5 |
| 4.3495 | 4.1299 | 0.5 |
| 4.4697 | 4.0854 | 0.5 |
| 4.5871 | 4.0342 | 0.5 |
| 4.8129 | 3.9131 | 0.5 |
| 4.7016 | 3.9767 | 0.5 |
| 4.5583 | 3.0361 | 0.5 |
| 4.6858 | 3.0497 | 0.5 |
| 4.9358 | 3.1048 | 0.5 |
| 4.8119 | 3.0719 | 0.5 |
| 5.1911 | 3.5733 | 0.5 |
| 5.0544 | 3.1528 | 0.5 |
| 4.9198 | 3.8425 | 0.5 |
| 5.2404 | 3.4559 | 0.5 |
| 5.0208 | 3.7637 | 0.5 |
| 5.2325 | 3.3293 | 0.5 |
| 5.1128 | 3.6745 | 0.5 |
| 5.1595 | 3.2255 | 0.5 |
| 0.3550 | 0.5049 | 0.5 |
| 0.4520 | 0.7421 | 0.5 |
| 0.6315 | 0.5130 | 0.5 |
| 0.5010 | 0.8605 | 0.5 |
| 0.4034 | 0.6236 | 0.5 |
| 0.0693 | −0.2091 | 0.5 |
| 0.0220 | −0.3282 | 0.5 |
| 0.2403 | −0.1490 | 0.5 |
| 0.1769 | −0.2603 | 0.5 |
| 0.1167 | −0.0900 | 0.5 |
| 0.1641 | 0.0291 | 0.5 |
| 0.2115 | 0.1481 | 0.5 |
| 0.1138 | −0.3719 | 0.5 |
| −0.0254 | −0.4472 | 0.5 |
| 0.0513 | −0.4838 | 0.5 |
| 0.2592 | 0.2671 | 0.5 |
| 0.4333 | 0.1836 | 0.5 |
| 0.3070 | 0.3860 | 0.5 |
| 0.3684 | 0.0730 | 0.5 |
| 0.3041 | −0.0378 | 0.5 |
| 0.5647 | 0.4036 | 0.5 |
| 0.4987 | 0.2938 | 0.5 |
| 0.7018 | 1.3322 | 0.5 |

TABLE I-continued

| X | Y | Z |
|---|---|---|
| 0.8057 | 1.5665 | 0.5 |
| 0.8588 | 1.6832 | 0.5 |
| 0.7534 | 1.4495 | 0.5 |
| 0.6004 | 1.0968 | 0.5 |
| 0.6990 | 0.6220 | 0.5 |
| 0.6508 | 1.2146 | 0.5 |
| 0.5505 | 0.9788 | 0.5 |
| 0.7673 | 0.7304 | 0.5 |
| 0.9779 | 1.0521 | 0.5 |
| 0.9067 | 0.9455 | 0.5 |
| 0.8365 | 0.8383 | 0.5 |
| 1.0241 | 2.0303 | 0.5 |
| 0.9128 | 1.7994 | 0.5 |
| 0.9679 | 1.9151 | 0.5 |
| 1.2747 | 1.4700 | 0.5 |
| 1.0814 | 2.1449 | 0.5 |
| 1.3525 | 1.5718 | 0.5 |
| 1.1236 | 1.2629 | 0.5 |
| 1.0502 | 1.1579 | 0.5 |
| 1.1984 | 1.3670 | 0.5 |
| 1.5131 | 1.7715 | 0.5 |
| 1.4319 | 1.6724 | 0.5 |
| 1.5962 | 1.8691 | 0.5 |
| 1.6813 | 1.9650 | 0.5 |
| 1.8582 | 2.1505 | 0.5 |
| 1.7686 | 2.0588 | 0.5 |
| 1.9503 | 2.2396 | 0.5 |
| 0.1123 | −0.1757 | 0.6 |
| 0.1594 | −0.0461 | 0.6 |
| 0.4471 | 0.7298 | 0.6 |
| 0.3018 | 0.3424 | 0.6 |
| 0.3156 | −0.1108 | 0.6 |
| 0.2067 | 0.0835 | 0.6 |
| 0.2541 | 0.2130 | 0.6 |
| 0.3831 | 0.0095 | 0.6 |
| 0.3498 | 0.4717 | 0.6 |
| 0.3982 | 0.6008 | 0.6 |
| 0.5208 | 0.2485 | 0.6 |
| 0.4515 | 0.1293 | 0.6 |
| 0.7531 | 1.4987 | 0.6 |
| 0.9182 | 1.8781 | 0.6 |
| 0.8070 | 1.6257 | 0.6 |
| 0.8620 | 1.7521 | 0.6 |
| 1.0955 | 2.2519 | 0.6 |
| 0.9758 | 2.0034 | 0.6 |
| 1.0348 | 2.1281 | 0.6 |
| 0.4964 | 0.8586 | 0.6 |
| 0.5463 | 0.9872 | 0.6 |
| 0.5969 | 1.1155 | 0.6 |
| 0.7002 | 1.3713 | 0.6 |
| 0.8839 | 0.8347 | 0.6 |
| 0.8089 | 0.7190 | 0.6 |
| 0.6482 | 1.2436 | 0.6 |
| 0.6626 | 0.4851 | 0.6 |
| 0.5912 | 0.3671 | 0.6 |
| 0.7352 | 0.6024 | 0.6 |
| 0.9602 | 0.9497 | 0.6 |
| 1.1168 | 1.1767 | 0.6 |
| 1.0378 | 1.0637 | 0.6 |
| 1.1974 | 1.2887 | 0.6 |
| 1.2795 | 1.3995 | 0.6 |
| 1.6584 | 3.1995 | 0.6 |
| 1.7412 | 3.3098 | 0.6 |
| 1.8273 | 3.4175 | 0.6 |
| 2.0104 | 3.6237 | 0.6 |
| 2.1077 | 3.7215 | 0.6 |
| 2.2089 | 3.8152 | 0.6 |
| 1.9170 | 3.5223 | 0.6 |
| 2.4235 | 3.9884 | 0.6 |
| 2.5368 | 4.0670 | 0.6 |
| 2.6539 | 4.1399 | 0.6 |
| 2.3142 | 3.9043 | 0.6 |
| 1.1579 | 2.3750 | 0.6 |
| 1.2222 | 2.4970 | 0.6 |
| 1.3572 | 2.7375 | 0.6 |
| 1.4283 | 2.8557 | 0.6 |
| 1.2885 | 2.6179 | 0.6 |

TABLE I-continued

| X | Y | Z |
|---|---|---|
| 1.4490 | 1.6171 | 0.6 |
| 1.5365 | 1.7238 | 0.6 |
| 1.6259 | 1.8287 | 0.6 |
| 1.5021 | 2.9722 | 0.6 |
| 1.5787 | 3.0869 | 0.6 |
| 1.8111 | 2.0332 | 0.6 |
| 1.7174 | 1.9319 | 0.6 |
| 1.9071 | 2.1322 | 0.6 |
| 2.0056 | 2.2288 | 0.6 |
| 1.3633 | 1.5090 | 0.6 |
| 2.3171 | 2.5009 | 0.6 |
| 2.2104 | 2.4134 | 0.6 |
| 2.1066 | 2.3226 | 0.6 |
| 2.4266 | 2.5847 | 0.6 |
| 2.7734 | 2.8099 | 0.6 |
| 2.6548 | 2.7396 | 0.6 |
| 2.5392 | 2.6644 | 0.6 |
| 2.8951 | 2.8748 | 0.6 |
| 2.8989 | 4.2663 | 0.6 |
| 2.7747 | 4.2064 | 0.6 |
| 3.0263 | 4.3193 | 0.6 |
| 3.1564 | 4.3649 | 0.6 |
| 3.2890 | 4.4030 | 0.6 |
| 3.4235 | 4.4331 | 0.6 |
| 3.5596 | 4.4554 | 0.6 |
| 3.6968 | 4.4699 | 0.6 |
| 3.8345 | 4.4766 | 0.6 |
| 3.9724 | 4.4756 | 0.6 |
| 4.1101 | 4.4671 | 0.6 |
| 4.2470 | 4.4510 | 0.6 |
| 4.3829 | 4.4274 | 0.6 |
| 4.5173 | 4.3964 | 0.6 |
| 4.6497 | 4.3579 | 0.6 |
| 4.7797 | 4.3118 | 0.6 |
| 3.1473 | 2.9864 | 0.6 |
| 3.0198 | 2.9337 | 0.6 |
| 3.2773 | 3.0323 | 0.6 |
| 3.4096 | 3.0713 | 0.6 |
| 3.6794 | 3.1283 | 0.6 |
| 3.5438 | 3.1032 | 0.6 |
| 3.9534 | 3.1596 | 0.6 |
| 3.8160 | 3.1470 | 0.6 |
| 4.2290 | 3.1701 | 0.6 |
| 4.0911 | 3.1669 | 0.6 |
| 4.5048 | 3.1703 | 0.6 |
| 4.3669 | 3.1707 | 0.6 |
| 4.7806 | 3.1741 | 0.6 |
| 4.6428 | 3.1708 | 0.6 |
| 5.0554 | 3.1973 | 0.6 |
| 4.9183 | 3.1822 | 0.6 |
| 4.9067 | 4.2580 | 0.6 |
| 5.0304 | 4.1970 | 0.6 |
| 5.1505 | 4.1292 | 0.6 |
| 5.3242 | 3.2580 | 0.6 |
| 5.1911 | 3.2219 | 0.6 |
| 5.3762 | 3.9710 | 0.6 |
| 5.6299 | 3.5111 | 0.6 |
| 5.4772 | 3.8773 | 0.6 |
| 5.5612 | 3.3937 | 0.6 |
| 5.5642 | 3.7705 | 0.6 |
| 5.4510 | 3.3116 | 0.6 |
| 5.2662 | 4.0542 | 0.6 |
| 5.6252 | 3.6473 | 0.6 |
| 0.1183 | −0.4745 | 0.6 |
| −0.0288 | −0.5647 | 0.6 |
| 0.0546 | −0.5968 | 0.6 |
| 0.0182 | −0.4351 | 0.6 |
| 0.0652 | −0.3054 | 0.6 |
| 0.2490 | −0.2316 | 0.6 |
| 0.1832 | −0.3528 | 0.6 |
| 0.5376 | 1.0003 | 0.7 |
| 0.5687 | 1.1392 | 0.7 |
| 0.4873 | 0.8611 | 0.7 |
| 0.7485 | 1.5535 | 0.7 |
| 0.6409 | 1.2777 | 0.7 |
| 0.6941 | 1.4158 | 0.7 |
| 0.8042 | 1.6906 | 0.7 |

TABLE I-continued

| X | Y | Z |
|---|---|---|
| 0.8614 | 1.8271 | 0.7 |
| 0.9202 | 1.9629 | 0.7 |
| 0.9808 | 2.0980 | 0.7 |
| 1.0433 | 2.2322 | 0.7 |
| 1.1079 | 2.3654 | 0.7 |
| 1.0998 | 1.0792 | 0.7 |
| 1.0152 | 0.9578 | 0.7 |
| 1.1862 | 1.1994 | 0.7 |
| 1.2744 | 1.3183 | 0.7 |
| 0.1992 | 0.0210 | 0.7 |
| 0.0579 | −0.7092 | 0.7 |
| 0.0141 | −0.5413 | 0.7 |
| 0.0602 | −0.4007 | 0.7 |
| −0.0320 | −0.6820 | 0.7 |
| 0.2568 | −0.3122 | 0.7 |
| 0.1889 | −0.4438 | 0.7 |
| 0.1063 | −0.2601 | 0.7 |
| 0.1226 | −0.5761 | 0.7 |
| 0.1527 | −0.1195 | 0.7 |
| 0.2460 | 0.1614 | 0.7 |
| 0.2932 | 0.3017 | 0.7 |
| 0.3890 | 0.5818 | 0.7 |
| 0.5420 | 0.2065 | 0.7 |
| 0.4378 | 0.7216 | 0.7 |
| 0.4686 | 0.0780 | 0.7 |
| 0.3408 | 0.4419 | 0.7 |
| 0.3260 | −0.1814 | 0.7 |
| 0.3966 | −0.0513 | 0.7 |
| 0.7715 | 0.5866 | 0.7 |
| 0.6934 | 0.4609 | 0.7 |
| 0.6170 | 0.3341 | 0.7 |
| 0.8511 | 0.7114 | 0.7 |
| 0.9323 | 0.8352 | 0.7 |
| 1.2438 | 2.6283 | 0.7 |
| 1.3156 | 2.7578 | 0.7 |
| 1.1746 | 2.4974 | 0.7 |
| 1.3901 | 2.8856 | 0.7 |
| 1.4676 | 3.0117 | 0.7 |
| 1.8112 | 3.4935 | 0.7 |
| 1.5483 | 3.1358 | 0.7 |
| 1.6324 | 3.2576 | 0.7 |
| 1.7200 | 3.3769 | 0.7 |
| 1.6467 | 1.7784 | 0.7 |
| 1.4565 | 1.5517 | 0.7 |
| 1.3644 | 1.4358 | 0.7 |
| 1.5506 | 1.6659 | 0.7 |
| 1.8456 | 1.9977 | 0.7 |
| 1.7451 | 1.8891 | 0.7 |
| 1.9485 | 2.1041 | 0.7 |
| 2.0537 | 2.2082 | 0.7 |
| 2.2152 | 3.9256 | 0.7 |
| 1.9062 | 3.6070 | 0.7 |
| 2.0051 | 3.7170 | 0.7 |
| 2.1081 | 3.8234 | 0.7 |
| 2.6842 | 4.2855 | 0.7 |
| 2.7401 | 2.7699 | 0.7 |
| 2.3263 | 4.0233 | 0.7 |
| 2.4416 | 4.1161 | 0.7 |
| 2.5609 | 4.2036 | 0.7 |
| 2.8644 | 2.8503 | 0.7 |
| 2.3846 | 2.5042 | 0.7 |
| 2.2716 | 2.4085 | 0.7 |
| 2.1614 | 2.3098 | 0.7 |
| 2.5003 | 2.5965 | 0.7 |
| 2.6188 | 2.6852 | 0.7 |
| 2.8113 | 4.3614 | 0.7 |
| 2.9419 | 4.4311 | 0.7 |
| 3.0758 | 4.4941 | 0.7 |
| 3.2127 | 4.5503 | 0.7 |
| 3.3523 | 4.5993 | 0.7 |
| 3.4943 | 4.6410 | 0.7 |
| 3.6384 | 4.6751 | 0.7 |
| 3.1218 | 2.9963 | 0.7 |
| 2.9916 | 2.9259 | 0.7 |
| 3.2549 | 3.0610 | 0.7 |
| 3.3908 | 3.1197 | 0.7 |
| 3.6703 | 3.2169 | 0.7 |

TABLE I-continued

| X | Y | Z |
|---|---|---|
| 3.5293 | 3.1718 | 0.7 |
| 3.8134 | 3.2547 | 0.7 |
| 3.9581 | 3.2855 | 0.7 |
| 4.2264 | 4.7335 | 0.7 |
| 3.7840 | 4.7014 | 0.7 |
| 3.9308 | 4.7200 | 0.7 |
| 4.0784 | 4.7307 | 0.7 |
| 4.8133 | 4.6649 | 0.7 |
| 4.3743 | 4.7284 | 0.7 |
| 4.5217 | 4.7153 | 0.7 |
| 4.6682 | 4.6942 | 0.7 |
| 4.3989 | 3.3369 | 0.7 |
| 4.2513 | 3.3261 | 0.7 |
| 4.1042 | 3.3092 | 0.7 |
| 4.5468 | 3.3428 | 0.7 |
| 4.9908 | 3.3474 | 0.7 |
| 4.8428 | 3.3460 | 0.7 |
| 4.6947 | 3.3452 | 0.7 |
| 4.9564 | 4.6271 | 0.7 |
| 5.0969 | 4.5806 | 0.7 |
| 5.3676 | 4.4614 | 0.7 |
| 5.4970 | 4.3896 | 0.7 |
| 5.2341 | 4.5253 | 0.7 |
| 5.2864 | 3.3616 | 0.7 |
| 5.1387 | 3.3518 | 0.7 |
| 5.4333 | 3.3792 | 0.7 |
| 5.5787 | 3.4071 | 0.7 |
| 5.8501 | 4.1223 | 0.7 |
| 5.6217 | 4.3099 | 0.7 |
| 5.7404 | 4.2216 | 0.7 |
| 5.9455 | 4.0093 | 0.7 |
| 6.0166 | 3.8799 | 0.7 |
| 6.0318 | 3.7344 | 0.7 |
| 5.9694 | 3.6028 | 0.7 |
| 5.8551 | 3.5098 | 0.7 |
| 5.7208 | 3.4481 | 0.7 |
| 1.0560 | 2.3446 | 0.8 |
| 0.8628 | 1.9098 | 0.8 |
| 1.1253 | 2.4873 | 0.8 |
| 0.9249 | 2.0558 | 0.8 |
| 0.9893 | 2.2007 | 0.8 |
| 1.3503 | 2.9064 | 0.8 |
| 1.2723 | 2.7684 | 0.8 |
| 1.4316 | 3.0426 | 0.8 |
| 1.5164 | 3.1767 | 0.8 |
| 1.1974 | 2.6286 | 0.8 |
| 1.6970 | 3.4374 | 0.8 |
| 1.8607 | 1.9639 | 0.8 |
| 1.7932 | 3.5635 | 0.8 |
| 2.1965 | 2.3009 | 0.8 |
| 1.8934 | 3.6865 | 0.8 |
| 2.0821 | 2.1910 | 0.8 |
| 1.6048 | 3.3083 | 0.8 |
| 1.9702 | 2.0786 | 0.8 |
| 2.1061 | 3.9217 | 0.8 |
| 2.2187 | 4.0333 | 0.8 |
| 1.9976 | 3.8060 | 0.8 |
| 2.5814 | 4.3410 | 0.8 |
| 2.3355 | 4.1406 | 0.8 |
| 2.4564 | 4.2433 | 0.8 |
| 2.3132 | 2.4082 | 0.8 |
| 2.5542 | 2.6144 | 0.8 |
| 2.4324 | 2.5128 | 0.8 |
| 2.8058 | 2.8076 | 0.8 |
| 2.6786 | 2.7128 | 0.8 |
| 2.9357 | 2.8985 | 0.8 |
| 0.2829 | 0.2650 | 0.8 |
| 0.3302 | 0.4164 | 0.8 |
| 0.4270 | 0.7185 | 0.8 |
| 0.4768 | 0.8691 | 0.8 |
| 0.3782 | 0.5676 | 0.8 |
| 0.0545 | −0.4944 | 0.8 |
| 0.0098 | −0.6465 | 0.8 |
| 0.1945 | −0.5336 | 0.8 |
| 0.0995 | −0.3423 | 0.8 |
| 0.1270 | −0.6772 | 0.8 |
| 0.1447 | −0.1903 | 0.8 |

TABLE I-continued

| X | Y | Z |
|---|---|---|
| 0.1903 | −0.0383 | 0.8 |
| 0.2639 | −0.3910 | 0.8 |
| −0.0349 | −0.7987 | 0.8 |
| 0.0614 | −0.8216 | 0.8 |
| 0.2363 | 0.1134 | 0.8 |
| 0.4089 | −0.1089 | 0.8 |
| 0.3353 | −0.2494 | 0.8 |
| 0.4844 | 0.0306 | 0.8 |
| 0.5619 | 0.1690 | 0.8 |
| 0.6333 | 1.3184 | 0.8 |
| 0.5278 | 1.0193 | 0.8 |
| 0.5799 | 1.1691 | 0.8 |
| 0.6882 | 1.4672 | 0.8 |
| 0.7446 | 1.6155 | 0.8 |
| 0.8028 | 1.7630 | 0.8 |
| 0.8059 | 0.5774 | 0.8 |
| 0.7226 | 0.4425 | 0.8 |
| 0.6413 | 0.3063 | 0.8 |
| 0.9786 | 0.8435 | 0.8 |
| 0.8913 | 0.7111 | 0.8 |
| 1.1594 | 1.1041 | 0.8 |
| 1.3485 | 1.3588 | 0.8 |
| 1.2529 | 1.2322 | 0.8 |
| 1.0680 | 0.9745 | 0.8 |
| 1.5465 | 1.6066 | 0.8 |
| 1.4464 | 1.4836 | 0.8 |
| 1.7536 | 1.8469 | 0.8 |
| 1.6488 | 1.7278 | 0.8 |
| 2.9792 | 4.6015 | 0.8 |
| 3.1189 | 4.6764 | 0.8 |
| 2.8429 | 4.5204 | 0.8 |
| 3.5567 | 4.8618 | 0.8 |
| 3.7079 | 4.9097 | 0.8 |
| 3.2619 | 4.7450 | 0.8 |
| 3.4079 | 4.8069 | 0.8 |
| 3.3431 | 3.1440 | 0.8 |
| 3.2044 | 3.0671 | 0.8 |
| 2.7102 | 4.4334 | 0.8 |
| 3.0686 | 2.9851 | 0.8 |
| 3.4846 | 3.2155 | 0.8 |
| 3.9261 | 3.3920 | 0.8 |
| 3.7763 | 3.3400 | 0.8 |
| 3.6291 | 3.2810 | 0.8 |
| 4.1729 | 5.0086 | 0.8 |
| 3.8612 | 4.9504 | 0.8 |
| 4.0163 | 4.9834 | 0.8 |
| 4.8059 | 5.0257 | 0.8 |
| 4.3306 | 5.0256 | 0.8 |
| 4.4889 | 5.0342 | 0.8 |
| 4.6475 | 5.0343 | 0.8 |
| 4.3883 | 3.5031 | 0.8 |
| 4.2325 | 3.4736 | 0.8 |
| 4.0783 | 3.4366 | 0.8 |
| 4.5454 | 3.5250 | 0.8 |
| 5.0201 | 3.5553 | 0.8 |
| 4.8616 | 3.5499 | 0.8 |
| 4.7033 | 3.5402 | 0.8 |
| 4.9635 | 5.0083 | 0.8 |
| 5.1198 | 4.9817 | 0.8 |
| 5.2742 | 4.9454 | 0.8 |
| 5.4259 | 4.8992 | 0.8 |
| 5.6539 | 3.5790 | 0.8 |
| 5.4957 | 3.5672 | 0.8 |
| 5.3372 | 3.5612 | 0.8 |
| 5.1787 | 3.5582 | 0.8 |
| 5.8570 | 4.6998 | 0.8 |
| 5.9907 | 4.6145 | 0.8 |
| 6.1177 | 3.6790 | 0.8 |
| 5.5740 | 4.8426 | 0.8 |
| 5.9664 | 3.6314 | 0.8 |
| 5.7179 | 4.7760 | 0.8 |
| 5.8111 | 3.5995 | 0.8 |
| 6.3379 | 4.2925 | 0.8 |
| 6.2593 | 3.7498 | 0.8 |
| 6.4158 | 4.1549 | 0.8 |
| 6.1178 | 4.5198 | 0.8 |
| 6.4360 | 3.9992 | 0.8 |

TABLE I-continued

| X | Y | Z |
|---|---|---|
| 6.2351 | 4.4131 | 0.8 |
| 6.3778 | 3.8541 | 0.8 |
| 1.0037 | 2.3116 | 0.9 |
| 1.0755 | 2.4654 | 0.9 |
| 1.1504 | 2.6177 | 0.9 |
| 0.4664 | 0.8827 | 0.9 |
| 0.1354 | −0.2583 | 0.9 |
| 0.1799 | −0.0945 | 0.9 |
| 0.2706 | −0.4681 | 0.9 |
| 0.0914 | −0.4222 | 0.9 |
| 0.2714 | 0.2324 | 0.9 |
| 0.3184 | 0.3955 | 0.9 |
| 0.3665 | 0.5582 | 0.9 |
| 0.4158 | 0.7206 | 0.9 |
| 0.4201 | −0.1633 | 0.9 |
| 0.3440 | −0.3150 | 0.9 |
| 0.2252 | 0.0690 | 0.9 |
| 0.5797 | 0.1363 | 0.9 |
| 0.4987 | −0.0129 | 0.9 |
| 0.6845 | 1.5255 | 0.9 |
| 0.7436 | 1.6846 | 0.9 |
| 0.8049 | 1.8429 | 0.9 |
| 0.5184 | 1.0442 | 0.9 |
| 0.5720 | 1.2053 | 0.9 |
| 0.6273 | 1.3657 | 0.9 |
| 0.9348 | 2.1565 | 0.9 |
| 1.4172 | 1.4119 | 0.9 |
| 1.3144 | 1.2769 | 0.9 |
| 1.2141 | 1.1400 | 0.9 |
| 0.8686 | 2.0002 | 0.9 |
| 1.1162 | 1.0014 | 0.9 |
| 0.7489 | 0.4305 | 0.9 |
| 0.6631 | 0.2841 | 0.9 |
| 0.8371 | 0.5755 | 0.9 |
| 1.0207 | 0.8610 | 0.9 |
| 0.9277 | 0.7191 | 0.9 |
| 1.4841 | 3.2086 | 0.9 |
| 1.8799 | 3.7598 | 0.9 |
| 1.5769 | 3.3508 | 0.9 |
| 1.6737 | 3.4902 | 0.9 |
| 1.7746 | 3.6266 | 0.9 |
| 1.9895 | 3.8893 | 0.9 |
| 2.1034 | 4.0151 | 0.9 |
| 2.2216 | 4.1369 | 0.9 |
| 2.3440 | 4.2545 | 0.9 |
| 2.4704 | 4.3678 | 0.9 |
| 2.6008 | 4.4764 | 0.9 |
| 1.2286 | 2.7684 | 0.9 |
| 1.3101 | 2.9172 | 0.9 |
| 1.3952 | 3.0640 | 0.9 |
| 1.6304 | 1.6761 | 0.9 |
| 1.5225 | 1.5450 | 0.9 |
| 1.7407 | 1.8050 | 0.9 |
| 1.8537 | 1.9317 | 0.9 |
| 2.2084 | 2.2969 | 0.9 |
| 2.0875 | 2.1778 | 0.9 |
| 1.9693 | 2.0560 | 0.9 |
| 2.3319 | 2.4134 | 0.9 |
| 2.5859 | 2.6385 | 0.9 |
| 2.4578 | 2.5272 | 0.9 |
| 2.8495 | 2.8523 | 0.9 |
| 2.7164 | 2.7470 | 0.9 |
| 2.9853 | 2.9541 | 0.9 |
| 0.1319 | −0.7779 | 0.9 |
| −0.0375 | −0.9148 | 0.9 |
| 0.0660 | −0.9343 | 0.9 |
| 0.0051 | −0.7505 | 0.9 |
| 0.0480 | −0.5863 | 0.9 |
| 0.2000 | −0.6224 | 0.9 |
| 2.8730 | 4.6791 | 0.9 |
| 3.0145 | 4.7728 | 0.9 |
| 3.1595 | 4.8609 | 0.9 |
| 2.7350 | 4.5803 | 0.9 |
| 3.4594 | 5.0199 | 0.9 |
| 3.6139 | 5.0901 | 0.9 |
| 3.3079 | 4.9434 | 0.9 |
| 4.0937 | 5.2594 | 0.9 |

TABLE I-continued

| X | Y | Z |
|---|---|---|
| 3.7713 | 5.1537 | 0.9 |
| 3.9313 | 5.2102 | 0.9 |
| 4.5924 | 5.3596 | 0.9 |
| 4.7614 | 5.3760 | 0.9 |
| 4.2582 | 5.3010 | 0.9 |
| 4.4246 | 5.3345 | 0.9 |
| 3.2657 | 3.1453 | 0.9 |
| 3.1241 | 3.0519 | 0.9 |
| 3.4103 | 3.2343 | 0.9 |
| 3.8612 | 3.4702 | 0.9 |
| 3.7080 | 3.3972 | 0.9 |
| 3.5577 | 3.3184 | 0.9 |
| 4.0174 | 3.5365 | 0.9 |
| 4.5020 | 3.6916 | 0.9 |
| 4.3381 | 3.6475 | 0.9 |
| 4.1765 | 3.5958 | 0.9 |
| 5.0036 | 3.7768 | 0.9 |
| 4.8351 | 3.7561 | 0.9 |
| 4.6678 | 3.7279 | 0.9 |
| 5.2698 | 5.3675 | 0.9 |
| 4.9309 | 5.3830 | 0.9 |
| 5.1006 | 5.3803 | 0.9 |
| 5.9267 | 5.2050 | 0.9 |
| 5.4379 | 5.3441 | 0.9 |
| 5.6041 | 5.3096 | 0.9 |
| 5.7673 | 5.2634 | 0.9 |
| 6.5074 | 4.8582 | 0.9 |
| 6.0810 | 5.1346 | 0.9 |
| 6.2298 | 5.0530 | 0.9 |
| 6.3723 | 4.9608 | 0.9 |
| 6.6318 | 4.7428 | 0.9 |
| 6.7404 | 4.6126 | 0.9 |
| 5.1727 | 3.7912 | 0.9 |
| 5.5118 | 3.8057 | 0.9 |
| 5.3422 | 3.8004 | 0.9 |
| 5.8510 | 3.8176 | 0.9 |
| 5.6815 | 3.8103 | 0.9 |
| 6.1883 | 3.8546 | 0.9 |
| 6.0202 | 3.8312 | 0.9 |
| 6.5148 | 3.9450 | 0.9 |
| 6.3540 | 3.8909 | 0.9 |
| 6.8447 | 4.2979 | 0.9 |
| 6.7875 | 4.1403 | 0.9 |
| 6.6643 | 4.0247 | 0.9 |
| 6.8224 | 4.4646 | 0.9 |
| 0.3533 | 0.5514 | 1.0 |
| 0.5945 | 0.1065 | 1.0 |
| 0.2118 | 0.0267 | 1.0 |
| 0.4034 | 0.7254 | 1.0 |
| 0.5107 | −0.0541 | 1.0 |
| 0.2577 | 0.2020 | 1.0 |
| 0.4552 | 0.8990 | 1.0 |
| 0.3048 | 0.3769 | 1.0 |
| 0.6812 | 0.2655 | 1.0 |
| 0.5088 | 1.0720 | 1.0 |
| 0.7446 | 1.7570 | 1.0 |
| 0.8097 | 1.9260 | 1.0 |
| 0.6221 | 1.4161 | 1.0 |
| 0.6821 | 1.5870 | 1.0 |
| 1.0226 | 2.4258 | 1.0 |
| 1.1001 | 2.5896 | 1.0 |
| 0.8776 | 2.0939 | 1.0 |
| 1.1812 | 2.7515 | 1.0 |
| 0.9485 | 2.2606 | 1.0 |
| 1.4786 | 1.4737 | 1.0 |
| 0.9585 | 0.7328 | 1.0 |
| 0.5644 | 1.2444 | 1.0 |
| 0.8632 | 0.5787 | 1.0 |
| 0.7707 | 0.4230 | 1.0 |
| 1.0567 | 0.8849 | 1.0 |
| 1.3688 | 1.3297 | 1.0 |
| 1.2618 | 1.1835 | 1.0 |
| 1.1578 | 1.0352 | 1.0 |
| 0.0714 | −1.0475 | 1.0 |
| −0.0005 | −0.8536 | 1.0 |
| 0.1671 | −0.1488 | 1.0 |
| 0.2772 | −0.5446 | 1.0 |

TABLE I-continued

| X | Y | Z |
|---|---|---|
| 0.0399 | −0.6771 | 1.0 |
| 0.2056 | −0.7110 | 1.0 |
| 0.0812 | −0.5007 | 1.0 |
| 0.1372 | −0.8787 | 1.0 |
| −0.0399 | −1.0304 | 1.0 |
| 0.1236 | −0.3246 | 1.0 |
| 0.4298 | −0.2161 | 1.0 |
| 0.3519 | −0.3797 | 1.0 |
| 1.3547 | 3.0695 | 1.0 |
| 1.4474 | 3.2251 | 1.0 |
| 1.5442 | 3.3782 | 1.0 |
| 1.2660 | 2.9116 | 1.0 |
| 1.7509 | 3.6756 | 1.0 |
| 1.8609 | 3.8195 | 1.0 |
| 1.6454 | 3.5284 | 1.0 |
| 1.8248 | 1.8924 | 1.0 |
| 1.7066 | 1.7552 | 1.0 |
| 1.5912 | 1.6156 | 1.0 |
| 2.1971 | 2.2880 | 1.0 |
| 2.0700 | 2.1591 | 1.0 |
| 1.9459 | 2.0271 | 1.0 |
| 2.2183 | 4.2285 | 1.0 |
| 2.3462 | 4.3568 | 1.0 |
| 1.9755 | 3.9597 | 1.0 |
| 2.0947 | 4.0961 | 1.0 |
| 3.0149 | 3.0028 | 1.0 |
| 2.4782 | 4.4808 | 1.0 |
| 2.8727 | 2.8907 | 1.0 |
| 2.6141 | 4.6005 | 1.0 |
| 2.5954 | 2.6575 | 1.0 |
| 2.4601 | 2.5371 | 1.0 |
| 2.3273 | 2.4140 | 1.0 |
| 2.7329 | 2.7755 | 1.0 |
| 3.1947 | 5.0330 | 1.0 |
| 2.7539 | 4.7156 | 1.0 |
| 2.8974 | 4.8262 | 1.0 |
| 3.0444 | 4.9320 | 1.0 |
| 3.3483 | 5.1290 | 1.0 |
| 3.5048 | 5.2202 | 1.0 |
| 3.6641 | 5.3064 | 1.0 |
| 3.3077 | 3.2160 | 1.0 |
| 3.1599 | 3.1114 | 1.0 |
| 3.4584 | 3.3165 | 1.0 |
| 3.9279 | 3.5898 | 1.0 |
| 3.7685 | 3.5036 | 1.0 |
| 3.6120 | 3.4124 | 1.0 |
| 3.8263 | 5.3870 | 1.0 |
| 3.9915 | 5.4613 | 1.0 |
| 4.1598 | 5.5282 | 1.0 |
| 4.5050 | 5.6375 | 1.0 |
| 5.1205 | 4.0058 | 1.0 |
| 4.6811 | 5.6798 | 1.0 |
| 4.9431 | 3.9692 | 1.0 |
| 4.7676 | 3.9244 | 1.0 |
| 4.3311 | 5.5870 | 1.0 |
| 4.4235 | 3.8118 | 1.0 |
| 4.2553 | 3.7444 | 1.0 |
| 4.0901 | 3.6702 | 1.0 |
| 4.5943 | 3.8718 | 1.0 |
| 5.2993 | 4.0345 | 1.0 |
| 5.2188 | 5.7545 | 1.0 |
| 5.6599 | 4.0688 | 1.0 |
| 4.8590 | 5.7137 | 1.0 |
| 5.4792 | 4.0553 | 1.0 |
| 5.0383 | 5.7389 | 1.0 |
| 5.8408 | 4.0763 | 1.0 |
| 5.3998 | 5.7593 | 1.0 |
| 5.5808 | 5.7523 | 1.0 |
| 5.7608 | 5.7326 | 1.0 |
| 6.2028 | 4.0897 | 1.0 |
| 6.0219 | 4.0817 | 1.0 |
| 6.4477 | 5.5131 | 1.0 |
| 6.5626 | 4.1301 | 1.0 |
| 5.9388 | 5.6993 | 1.0 |
| 6.3833 | 4.1046 | 1.0 |
| 6.1135 | 5.6519 | 1.0 |
| 6.2835 | 5.5895 | 1.0 |

TABLE I-continued

| X | Y | Z |
|---|---|---|
| 6.7394 | 4.1691 | 1.0 |
| 7.0303 | 5.0881 | 1.0 |
| 7.1971 | 4.4418 | 1.0 |
| 6.6054 | 5.4241 | 1.0 |
| 7.1431 | 4.9465 | 1.0 |
| 7.0688 | 4.3150 | 1.0 |
| 6.7563 | 5.3240 | 1.0 |
| 7.2288 | 4.7874 | 1.0 |
| 6.9108 | 4.2273 | 1.0 |
| 6.8994 | 5.2131 | 1.0 |
| 7.2571 | 4.6102 | 1.0 |

It will also be appreciated that the airfoil disclosed in the above table may be scaled up or down geometrically for use in other similar turbine designs. Consequently, the coordinate values set forth in Table I may be scaled upwardly or downwardly such that the airfoil section shape remains unchanged. A scaled version of the coordinates in Table I is represented by X and Y distances in inches, multiplied or divided by the same number. The non-dimensional Z value, when converted to inches, may remain the same or be multiplied by the same or a different number similarly as the X and Y values for scalability.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine nozzle including an airfoil having an airfoil shape, said airfoil having a nominal profile substantially in accordance with Cartesian coordinate values of X, Y and Z set forth in Table I wherein the Z values are non-dimensional values within a range from 0.1 to 0.90 convertible to Z distances in inches by multiplying the Z values of Table I within said range by a height of the airfoil in inches, and wherein the X and Y values are distances in inches which, when connected by smooth continuing arcs, define airfoil profile sections at each distance Z within said range thereof, the profile sections at the Z distances within said range being joined smoothly with one another to form said nozzle airfoil shape.

2. A turbine nozzle according to claim 1 forming part of a third stage of a turbine.

3. A turbine nozzle according to claim 1 wherein the airfoil has a root radius of 29.255 inches at a trailing edge thereof and a height of 15.420 inches along the trailing edge, said nozzle comprising part of a third stage of a turbine.

4. A turbine nozzle according to claim 1 wherein said airfoil shape lies in an envelope within ±0.160 inches in a direction normal to any airfoil surface location.

5. A turbine nozzle including an airfoil having an uncoated nominal airfoil profile substantially in accordance with Cartesian coordinate values of X, Y and Z set forth in Table I wherein the Z values are non-dimensional values within a range from 0.1 to 0.9 convertible to Z distances in inches by multiplying the Z values of Table I within said range by a height of the airfoil in inches, and wherein the X and Y values are distances in inches which, when connected by smooth continuing arcs, define airfoil profile sections at each distance Z within said range thereof, the profile sections at the Z distances within said range thereof being joined smoothly with one another to form said nozzle airfoil shape, the X, Y and Z distances being scalable as a function of the same constant or number to provide a scaled-up or scaled-down airfoil.

6. A turbine nozzle according to claim 5 forming part of a third stage of a turbine.

7. A turbine nozzle according to claim 4 wherein the airfoil has a root radius of 29.255 inches at a trailing edge thereof and a height of 15.420 inches along the trailing edge, said nozzle comprising part of a third stage of a turbine.

8. A turbine comprising a turbine stage having a plurality of nozzles, each of said nozzles including an airfoil having an airfoil shape, said airfoil having a nominal profile substantially in accordance with Cartesian coordinate values of X, Y and Z set forth in Table I wherein the Z values are non-dimensional values within a range from 0.1 to 0.9 convertible to Z distances in inches by multiplying the Z values of Table I within said range by a height of the airfoil in inches, and wherein X and Y values are distances in inches which, when connected by smooth continuing arcs, define airfoil profile sections at each distance Z within said range, the profile sections at the Z distances within said range being joined smoothly with one another to form said nozzle airfoil shape.

9. A turbine according to claim 8 wherein the turbine nozzle comprises part of a third stage of the turbine.

10. A turbine according to claim 8 wherein the turbine stage has 64 airfoils and coordinate value Y extends parallel to an axis of rotation of the turbine.

11. A turbine according to claim 8 wherein each of the airfoils has a root radius of 29.255 inches at a trailing edge thereof and a height of 15.420 inches along the trailing edge, said turbine nozzle comprising a part of a third stage of the turbine.

12. A turbine according to claim 8 wherein said airfoil shape lies in an envelope within ±0.160 inches in a direction normal to any airfoil surface location.

* * * * *